US005645274A

United States Patent [19]

Ubayashi et al.

[11] Patent Number: 5,645,274

[45] Date of Patent: Jul. 8, 1997

[54] SHEET SUPPLY APPARATUS

[75] Inventors: Shinsuke Ubayashi; Yasumi Yoshida, both of Yokohama; Ryusei Kominato, Tokyo, all of Japan

[73] Assignee: Canon Kabushiki Kaisha, Japan

[21] Appl. No.: 309,141

[22] Filed: Sep. 20, 1994

[30] Foreign Application Priority Data

| | | | |
|---|---|---|---|
| Sep. 22, 1993 | [JP] | Japan | 5-261783 |
| Sep. 27, 1993 | [JP] | Japan | 5-262952 |
| Dec. 27, 1993 | [JP] | Japan | 5-354389 |
| Dec. 29, 1993 | [JP] | Japan | 5-355503 |

[51] Int. Cl.[6] ..... B65H 3/12

[52] U.S. Cl. ..... 271/94; 271/108; 271/104; 271/105; 271/265.04

[58] Field of Search ..... 271/94, 95, 265.04

[56] References Cited

U.S. PATENT DOCUMENTS

| | | | |
|---|---|---|---|
| 3,627,308 | 12/1971 | Stoever | 271/104 |
| 4,184,672 | 1/1980 | Watkins et al. | 271/108 |
| 5,090,676 | 2/1992 | Matsuno et al. | 271/94 |
| 5,092,578 | 3/1992 | Bergmeier et al. | 271/105 |
| 5,181,710 | 1/1993 | Takata et al. | 271/94 |
| 5,184,812 | 2/1993 | Namba | 271/108 |
| 5,190,276 | 3/1993 | Namba et al. | 271/105 |

FOREIGN PATENT DOCUMENTS

| | | | |
|---|---|---|---|
| 933341 | 9/1955 | Germany | 271/105 |

*Primary Examiner*—William E. Terrell
*Assistant Examiner*—Khoi M. Tran
*Attorney, Agent, or Firm*—Fitzpatrick, Cella, Harper & Scinto

[57] ABSTRACT

The present invention provides a sheet supply apparatus with a sheet supporting unit for supporting sheets, a sheet absorb device for absorbing a sheet supported by the sheet supporting unit to separate the sheet from the other sheets, a conveyer for conveying the sheet absorbed by the sheet absorb means, and a sheet feature detecting device for detecting rigidity of the sheet absorbed by the sheet absorb device.

20 Claims, 39 Drawing Sheets

12
3
23
16
11
10
8
13
c
d
6
7
4
14
17
A
15
31
C
18
9
20
e
θ
30
S1
22
S2
a
IN
CONTROL MEANS
b
19
30a
OUT
37
21
15a
14a
5
29
B
2
28
1
27

(TIMING CHART FOR SHEET SUPPLY)

SHEET SUPPLY APPARATUS

BACKGROUND OF THE INVENTION

1. Field of the Invention

The present invention relates to a sheet supply apparatus used with an image forming apparatus such as an electrophotographic copying machine, and more particularly, it relates to a sheet supply apparatus for separating and supplying sheets one by one from a sheet stack rested on a sheet tray by utilizing a suction force of air.

2. Related Background Art

In the past, sheet supply apparatuses used with image forming apparatuses such as electrophotographic copying machine are generally of roller type wherein a sheet is conveyed from a sheet stack rested on a sheet tray downwardly by means of a sheet supply roller. In such a conventional sheet supply apparatus of roller type, a surface of a roller is constituted by an elastic body such as rubber and supplying ability of the roller depends upon coefficient of friction of the roller surface. Accordingly, the supplying ability of the roller was unstable since the coefficient of friction of the roller surface was changed because of the change in configuration of the roller due to wear, deterioration of material of which the roller is made and/or adhesion of paper powder to the roller surface, and the conventional roller could not cope with various kinds of sheets having different surface features.

In order to eliminate the above drawbacks, there has been proposed an air sheet supply apparatus wherein a sheet is absorbed and conveyed by utilizing a suction force of air.

FIG. 42 shows a typical conventional air sheet supply apparatus. In FIG. 42, a sheet convey portion 1100 is arranged above a sheet tray 1101 on which sheets are stacked. The sheet convey portion 1100 includes a sheet absorb portion 1102, a convey belt 1103 having a plurality of absorb holes 1103*a*, and a blower 1104 for sucking air through the absorb holes 1103*a* and the sheet absorb portion 1102. In the proximity of a tip end of the sheet stack, there are arranged a nozzle 1105 for injecting air to float several sheets from the sheet stack, and a nozzle 1106 for blowing air against the sheet to separate an uppermost sheet from the other sheets. The nozzles 1105, 1106 are connected to a blower 1107 so that the air is supplied to these nozzles.

Such an air sheet supply apparatus is operated as follows. First of all, the air is injected from the nozzle 1105 under the action of the blower 1107 to float several sheets from the sheet stack rested on the sheet tray. Then, the uppermost sheet is absorbed to the convey belt 1103 under the action of the blower 1104. Thereafter, the convey belt is driven to convey the sheet downstreamly. In this case, the air from the nozzle 1106 is blown against the tip end of the sheet stack under the action of the blower 1107, thereby returning the double-fed sheets to separate the uppermost sheet from the other sheets. In this way, only the single sheet is conveyed to a pair of convey rollers 1108.

However, in the above-mentioned conventional sheet supply apparatus, in accordance with a weight of the sheet, the sheet could not be surely separated from the other sheets. For example, in case of light sheets, when the uppermost sheet was absorbed, a second sheet was also absorbed, thereby causing the double-feed of sheets. On the other hand, in case of heavy sheets, the uppermost sheet was not adequately absorbed to the convey belt 1103, so that the sheet was separated from the convey belt on the way, thereby causing the poor sheet supply.

SUMMARY OF THE INVENTION

An object of the present invention is to provide a sheet supply apparatus of air absorb type wherein sheets are positively separated from each other and the separated sheet is positively supplied, regardless of a weight of the sheet.

Incidentally, since the weight of the sheet cannot be detected directly, in the present invention, the weight of the sheet is indirectly detected by detecting rigidity of the sheet in consideration of the fact that the weight of the sheet is generally proportional to the rigidity of the sheet.

In order to achieve the above object, according to the present invention, there is provided a sheet supply apparatus comprising a sheet supporting means for supporting sheets, a sheet absorb means for absorbing a sheet supported by the sheet supporting means to separate the sheet from the other sheets, a convey means for conveying the sheet absorbed by the sheet absorb means, and a sheet feature detecting means for detecting rigidity of the sheet absorbed by the sheet absorb means.

With this arrangement, the optimum absorption of the sheet can be achieved by controlling an absorbing force of air absorption in accordance with the rigidity of the sheet, thereby separating the sheets positively.

Another object of the present invention is to provide a sheet supply apparatus the sheets are surely separated from each other and the separated sheet is positively supplied by appropriately setting a distance between an absorb position and a sheet stack in accordance with a weight of the sheet.

To achieve this object, according to the present invention, there is provided a sheet supply apparatus comprising a sheet supporting means mounted for lifting and lowering movements and adapted to support sheets, a sheet absorb means arranged above the sheet supporting means and adapted to absorb a sheet supported by the sheet supporting means to separate the sheet from the other sheets, a convey means for conveying the sheet absorbed by the sheet absorb means, a sheet feature detecting means for detecting rigidity of the sheet absorbed by the sheet absorb means, and a control means for controlling the lifting and lowering movements of the sheet supporting means to change a distance between the sheet absorb means and an uppermost sheet in accordance with the rigidity of the sheet.

A further object of the present invention is to provide an air sheet supply apparatus in which sheets are separated from each other by deforming the sheet and in which the sheets can positively be separated from each other by appropriately setting a deformed amount of the sheet in accordance with a weight of the sheet.

To achieve this object, according to the present invention, there is provided a sheet supply apparatus comprising a sheet supporting means for supporting sheets, a first sheet absorb means for absorbing a sheet supported by the sheet supporting means, a second sheet absorb means arranged at a downstream side of the first sheet absorb means and having an absorb surface inclined with respect to an absorb surface of the first sheet absorb means in order to absorb the sheet absorbed by the first sheet absorb means while bending a tip end of said sheet, an angle changing means for changing angles of the absorb surfaces of the first and second sheet absorb means, a convey means for conveying the sheet absorbed by the first and second sheet absorb means, a sheet feature detecting means for detecting rigidity of the sheet absorbed by the sheet absorb means, and a control means for controlling the angle changing means to change the angles of the absorb surfaces of the first and second sheet absorb means in accordance with the rigidity of the sheet detected by the sheet feature detecting means.

DETAILED DESCRIPTION OF THE PREFERRED EMBODIMENTS

The present invention will now be explained in connection with embodiments thereof with reference to the accompanying drawings.

Figure 1:
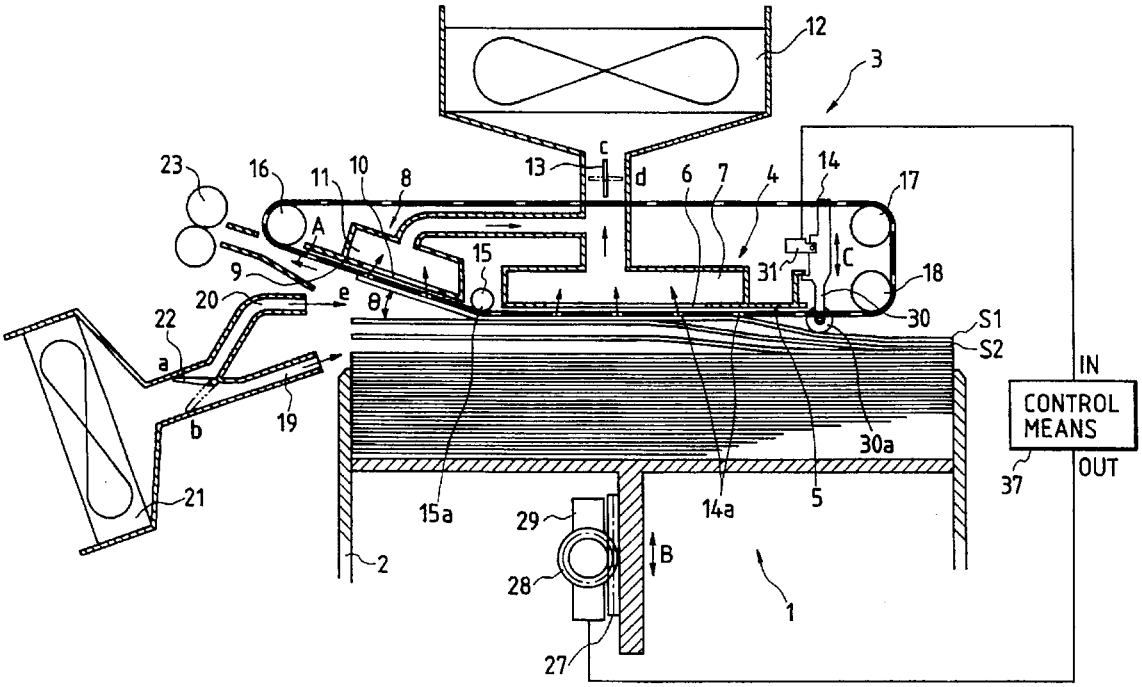
FIG. 1 is a sectional view of a sheet supply apparatus of air absorb type having a sheet feature detecting means.

In FIG. 1 showing an air sheet supply apparatus used with an electrophotographic copying machine, a plurality of sheets S are stacked on a sheet tray 1 in such a manner that tip ends of the sheets are abutted against a sheet align guide plate 2. The sheet supply apparatus include a sheet convey portion 3, and a first sheet absorb portion comprising a substantially flat bottom surface 5 opposed to the sheet stack rested on the sheet tray 1, an air suction opening 6 formed in the flat bottom surface 5, and a suction chamber 7.

A second sheet absorb portion 8 is arranged at a downstream side of the substantially flat bottom surface 5 in a sheet conveying direction and comprises a substantially flat bottom surface 9 inclined upwardly from the substantially flat bottom surface 5, an air suction opening 10 formed in the flat bottom surface 9, and a suction chamber 11.

The first and second sheet absorb portions 4, 8 connected to an air suction blower 12. The operation of the blower 12 is turned ON/OFF by a valve 13. A convey belt 14 is mounted on the first and second sheet absorb portions 4, 8 to cover surfaces of these portions. A plurality of air suction holes 14*a* are formed in the convey belt 14. The convey belt 14 is supported by rollers 15, 16, 17, 18 with predetermined tension and is intermittently driven toward a direction shown by the arrow A by a drive means (not shown) to convey the sheet. The roller 15 is arranged at a junction between the first and second flat bottom surfaces 5, 9 and acts as a displacement fulcrum 15*a* for deforming the sheet in a downwardly convex shape.

There are provided nozzle 19 for injection air to float several sheets, and a nozzle 20 for injecting air to separate a single sheet from the other sheets. The nozzles 19, 20 are connected to an air injection blower 21. Air injections from the nozzles 19, 20 are selectively switched by a valve 22. A pair of convey rollers 23 are provided for further conveying the sheet downstreamly.

Next, a mechanism for lifting and lowering the sheet tray 1 will be explained.

A rack 27 attached to the sheet tray 1 is engaged by a pinion gear 28 to be shifted in a direction shown by the arrow B in FIG. 1. The pinion gear 28 is rotated by a motor 29. These elements serve to set the sheet tray 1 at a height satisfying the following two conditions in accordance with the sheet to be conveyed. The first condition is to completely absorb only an uppermost sheet S1 to the second sheet absorb portion 8, and the second condition is to prevent the absorption of a second sheet S2 simultaneously with the absorption of the first or uppermost sheet S1. However, if a weight of the sheet is changed, the above conditions cannot often be satisfied adequately. Thus, the illustrated embodiment aims to satisfy the above conditions even if the weight of the sheet is changed.

By the way, the weight of the sheet (per unit area) is generally proportional to rigidity of the sheet. Thus, in place of the measurement of the weight of the sheet, the weight of the sheet is detected indirectly by detecting the rigidity of the sheet.

Now, a sheet feature detecting means for detecting the rigidity of the sheet will be explained. The detecting means comprises a detection member 30 movable in a direction shown by the arrow C, and a photosensor 31 for detecting a position of the detection member 30. A roller 30*a* is mounted on a lower end of the detection member 30 not to obstruct the conveyance of the sheet.

Figure 3:
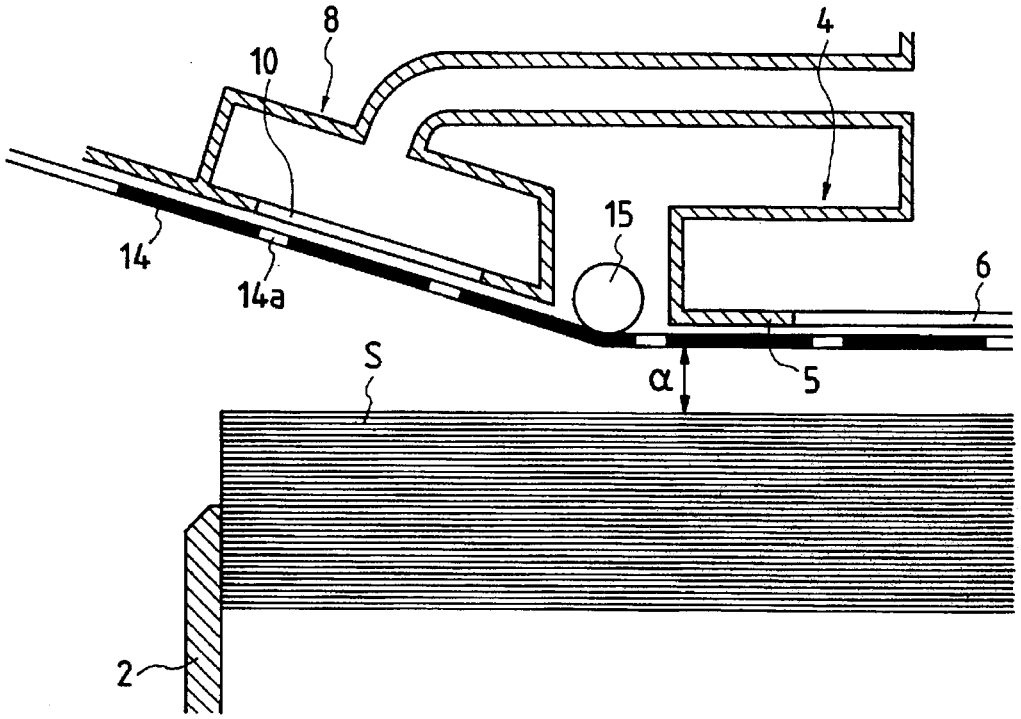
FIG. 3 is a sectional view similar to FIG. 1, showing an uppermost position of the sheet when the sheet having great rigidity is supplied.

Next, when the sheet has great rigidity, an operation of the above-mentioned air sheet supply apparatus will be explained with reference to FIG. 1. First of all, the sheet tray 1 is positioned near the convey belt 14 (FIG. 3). This is a home position. When the valve 22 is switched to a position a by a switching means such as a solenoid and the like (not shown) and the blower 21 is operated, the air is injected from the nozzle 19 toward a tip end of the sheet stack. As a result, several sheets are floated. Then, when the valve 13 is switched to a position c by a switching means such as a solenoid and the like (not shown) and the blower 12 is operated, the air is sucked through the suction openings 6, 10 and the suction holes 14*a* of the convey belt 14.

Consequently, the uppermost sheet S1 is absorbed to the first and second sheet absorb portions 4, 8 to be closely contacted with the convey belt 14. More specifically, as shown in FIG. 1, a main portion (central portion and rear portion) of the sheet is absorbed to the first sheet absorb means 4 and a tip end portion of the sheet is absorbed to the second absorb portion 8. Although a downwardly directed force is applied to the detection member 30 due to its own weight, since the rigidity of the sheet is great, the rear end portion of the sheet is not lowered greatly, with the result that the detection member 30 is pushed up by the sheet, thereby turning the photo-sensor 31 ON. A control means 37 receives a signal from the photo-sensor 31 and judges the rigidity of the sheet.

In general, it can be judged that the sheet is heavy (thick) when the rigidity of the sheet is great and that the sheet is light (thin) when the rigidity of the sheet is small. In the illustrated case, since the sheet is heavy and is hard to be absorbed to the convey belt 14, the position of the sheet tray 1 remains in the proximity of the convey belt 14. In this case, the sheet is supplied as follows. That is to say, the first sheet S1 is closely contacted with the first sheet absorb portion 4 and the second sheet absorb portion 8. Namely, the first sheet S1 follows the substantially flat bottom surfaces 5, 9 to be deformed around the displacement fulcrum 15*a* in a downwardly convex L-shaped configuration. On the other hand, the second sheet S2 is not deformed around the displacement fulcrum 15*a* to keep a flat condition. As a result, a tip end of the second sheet is separated from a tip end of the first sheet to create a gap e therebetween.

Thereafter, the convey belt 14 is driven by the drive means (not shown) to convey the sheet S1 in the direction shown by the arrow A. At the same time, the valve is switched to a position b, so that the air is injected from the nozzle 20 toward the gap e between the sheets S1, S2, thereby separating the sheet S2 from the sheet S1 stably. Accordingly, the sheet S1 alone is conveyed downstreamly to reach the pair of convey rollers 23. Thereafter, an image is formed on the sheet by an image forming apparatus which will be described later.

Figure 2:
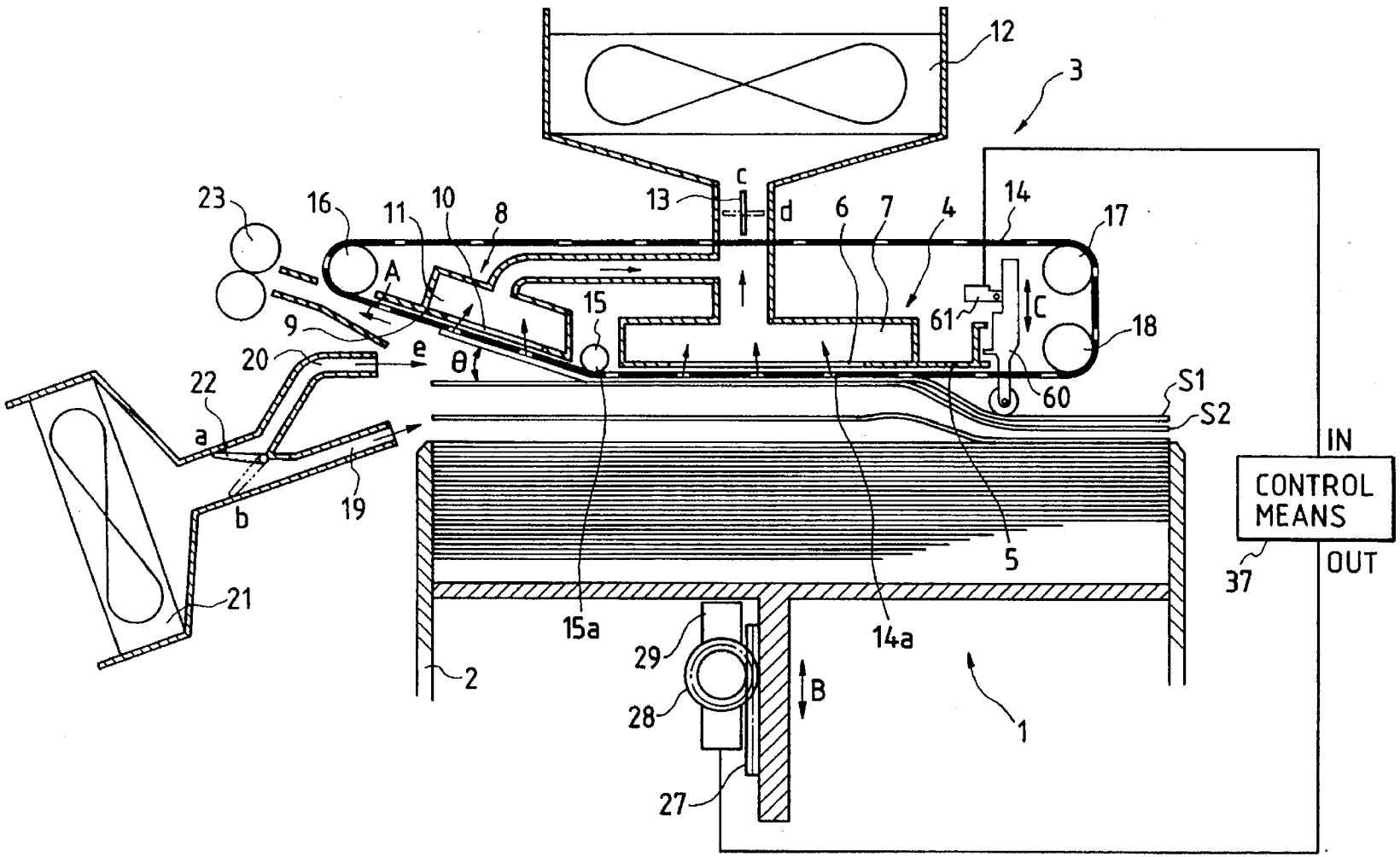
FIG. 2 is a sectional view similar to FIG. 1, showing a condition that a sheet having small rigidity is supplied.

FIG. 2 shows a setting condition when the rigidity of the sheet is small. Since the downwardly directed force acts on the detection member 30 due to its own weight, when the sheet is absorbed, a rear end portion of the sheet is spaced apart from the flat bottom surface 5 greatly. That is to say, the detection member 30 is kept in a lowered condition, thereby turning the photo-sensor 31 OFF. The control means 37 receiving a signal from the photo-sensor 31 judges the thickness (weight) of the sheet. In the illustrated case, since the sheet is light, if the position of the sheet tray 1 is high, a distance $\alpha$ between the first sheet S1 and the first sheet absorb portion 4 is small, with the result that the strong absorbing force acts on the sheets, thereby absorbing the second sheet S2 together with the first sheet S1. Thus, in this case, the position of the sheet tray 1 must be lowered.

Figure 4:
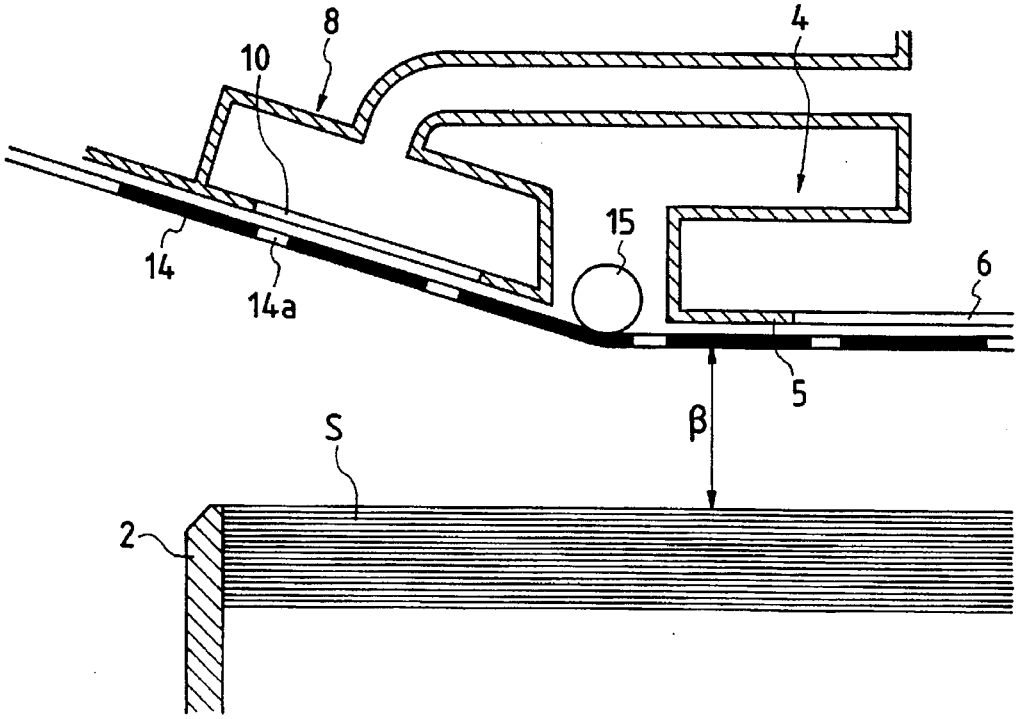
FIG. 4 is a sectional view similar to FIG. 1, showing an uppermost position of the sheet when the sheet having small rigidity is supplied.

To do so, the motor 28 is driven by the control means 37 to lower the rack 27 via the pinion gear 28, thereby lowering the sheet tray 1 to satisfy the above-mentioned conditions (FIG. 4). As a result, a distance between the first sheet S1 and the first sheet absorb portion 4 is increased to $\beta$. Thus, the sheet S1 alone is deformed around the displacement fulcrum 15*a* in opposition to the rigidity of the sheet so that the entire sheet S1 is closely contacted with the convey belt 14. Then, the sheet is supplied in the same manner as that described in connection with the sheet having the great rigidity. After the sheet supplying operation is finished, the sheet tray 1 is shifted so that the uppermost sheet on the sheet stack reaches the home position.

In the illustrated embodiment, while an example that a two-stage shifting movement of the detection member 30 is measured or detected was explained, the present invention is not limited to such an example. For example, a multi-stage shifting movement of the detection member or a stageless shifting movement of the detection member may be measured by using a slide volume and the like so that various kinds of sheets can be stably supplied. Further, in the illustrated embodiment, while an example that the detection member is lowered by its own weight was explained, the present invention is not limited to such an example, but, any force directing to a direction opposite to the sheet absorbing direction may be applied to the detection member by using a spring and the like, for instance.

Figure 5:
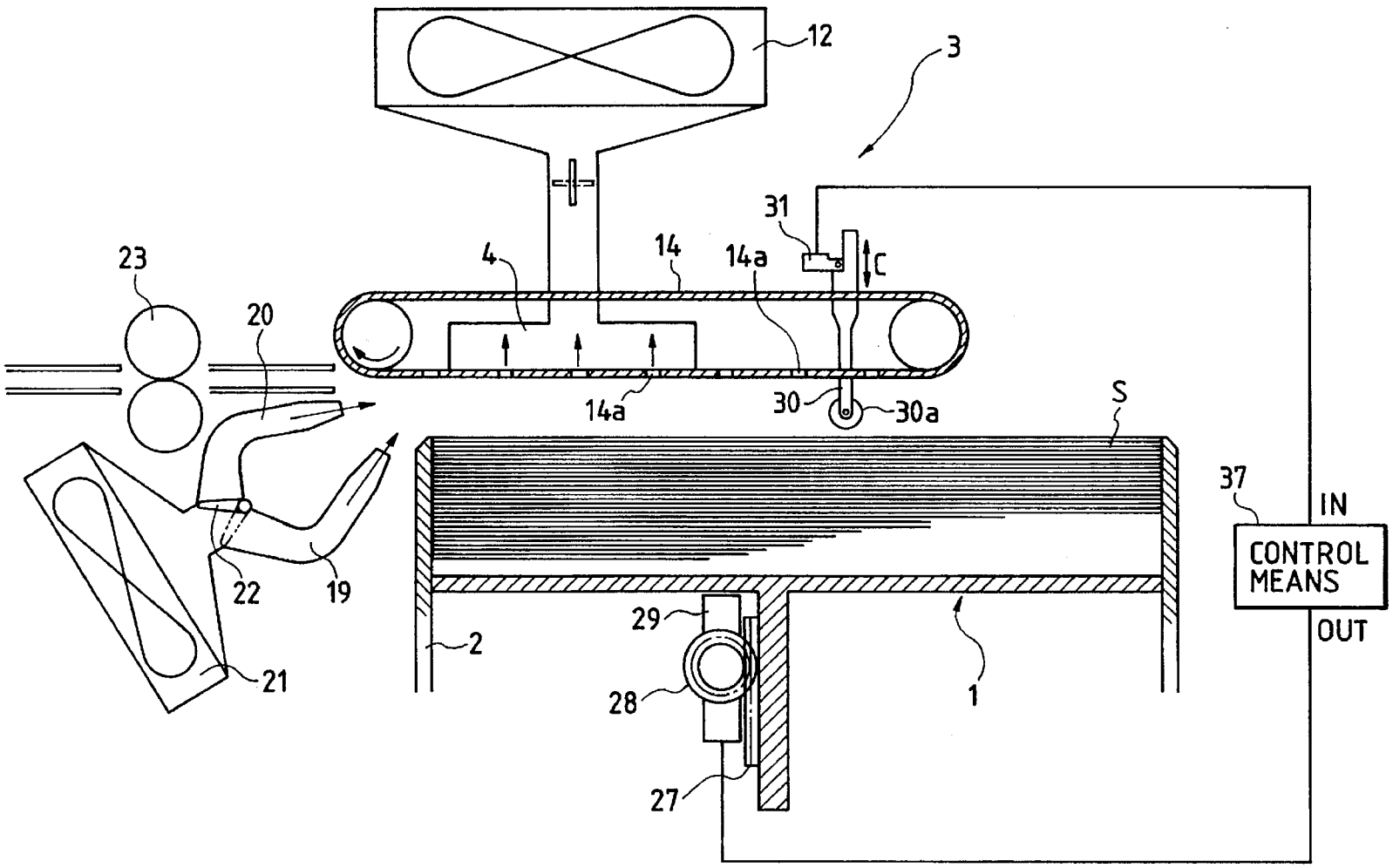
FIG. 5 is a sectional view showing an example a sheet feature detecting means is provided in a sheet supply apparatus having a flat sheet absorb surface.

Further, in the illustrated embodiment, while an example that the rigidity of the sheet is detected at the rear end portion of the sheet was explained, the present invention is not limited to such an example, but, the rigidity of the sheet may be detected at a front end portion or a side portion of the sheet. Furthermore, in the illustrated embodiment, while the height of the sheet tray 1 was changed in accordance with the rigidity of the sheet, a height of the first sheet absorb portion 4 may be changed or the distance between the sheet tray 1 and the first sheet absorb portion 4 may be changed. In addition, in the illustrated embodiment, while an example that the sheet convey portion has the first and second sheet absorb portions was explained, the present invention is not limited to such an example, but, as shown in FIG. 5, a single sheet absorb portion may be provided.

Further, in the illustrated embodiment, while the sheet tray 1 was returned to the home position adjacent to the convey belt after the sheet supplying operation was finished, the sheet tray 1 may be returned to the home position before the sheet supplying operation is started.

Figure 6:
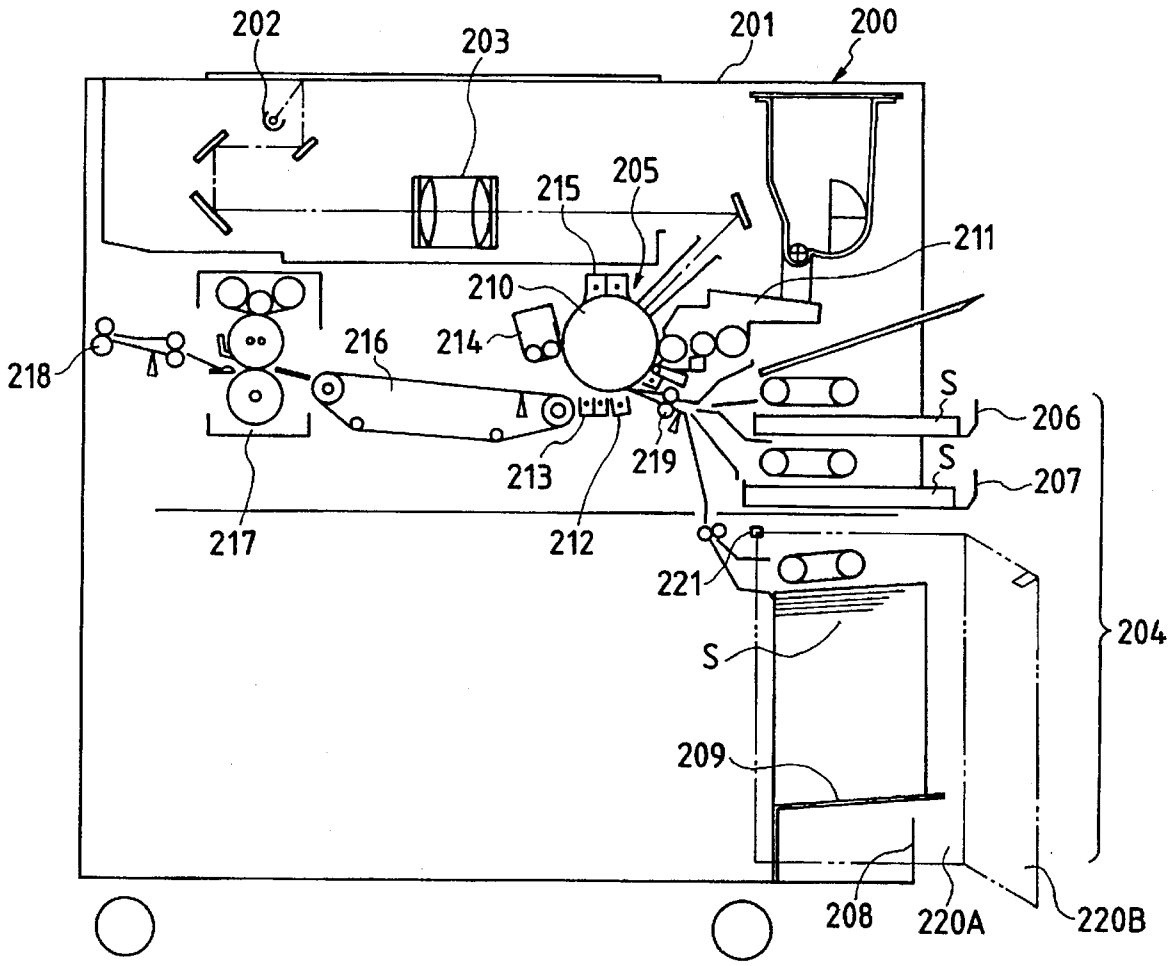
FIG. 6 is a sectional view of an image forming apparatus into which the sheet supply apparatus of FIG. 1 is incorporated.

FIG. 6 shows an image forming apparatus having the above-mentioned sheet supply apparatus. The image forming apparatus 200 comprises an original resting plate 201, a light source 202, a lens system 203, a sheet supply portion 204, and an image forming portion (image forming means) 205. The sheet supply portion 204 has cassettes 206, 207 adapted to contain the sheets therein and removably mounted to the image forming apparatus 200, and a deck 209 arranged on a pedestal 208. The air sheet supply apparatus is arranged in the sheet supply portion 204. The image forming portion 205 includes a cylindrical photosensitive body 210, a developing devices 211 containing toner therein, a transfer charger 213, a cleaner 214, and a first charger 215. At a downstream side of the image forming portion 205, there are arranged a convey device 216, a fixing device 217, and a pair of discharge rollers 218.

In the image forming apparatus having the above-mentioned construction, when a sheet supply signal is emitted from a control device (not shown) of the image forming apparatus 200, a sheet S is supplied from a cassette 206 or 206, or the deck 209. On the other hand, light emitted from the light source 202 is reflected by an original rested on the original resting plate 201 and then is illuminated onto the photosensitive body 210 through the lens system 203. When the photosensitive body 210 previously charged by the first charger is illuminated by the light, an electrostatic latent image is formed on the photosensitive body. Then, the latent image is developed by the developing device 211 as a toner image. Meanwhile, the sheet S supplied from the sheet supply portion 204 reaches a pair of resist rollers 219 where the skew-feed of the sheet is corrected, and then, the sheet is sent to the image forming portion 205 in a timed relation to the toner image. In the image forming portion 205, the toner image formed on the photosensitive body 210 is transferred onto the sheet S by the transfer charger 212, and then, the sheet S to which the toner image was transferred is separated from the photosensitive body 210 by charging the sheet with polarity opposite to polarity of the transfer charger 212 by means of a separation charger 213.

The separated sheet S is sent, by the convey device 216, to the fixing device 217, where a non-fixed toner image is permanently fixed to the sheet S. Thereafter, the sheet S is discharged out of the image forming apparatus 200 by means of the pair of discharge rollers 218. In this way, the sheet S supplied from the sheet supply portion 204 is discharged after the image was formed on the sheet.

Next, a sheet feature detecting means for detecting the rigidity of the sheet according to another embodiment will be explained. Incidentally, since the sheet supply apparatus itself is the same as the aforementioned one, explanation thereof will be omitted.

Figure 7:
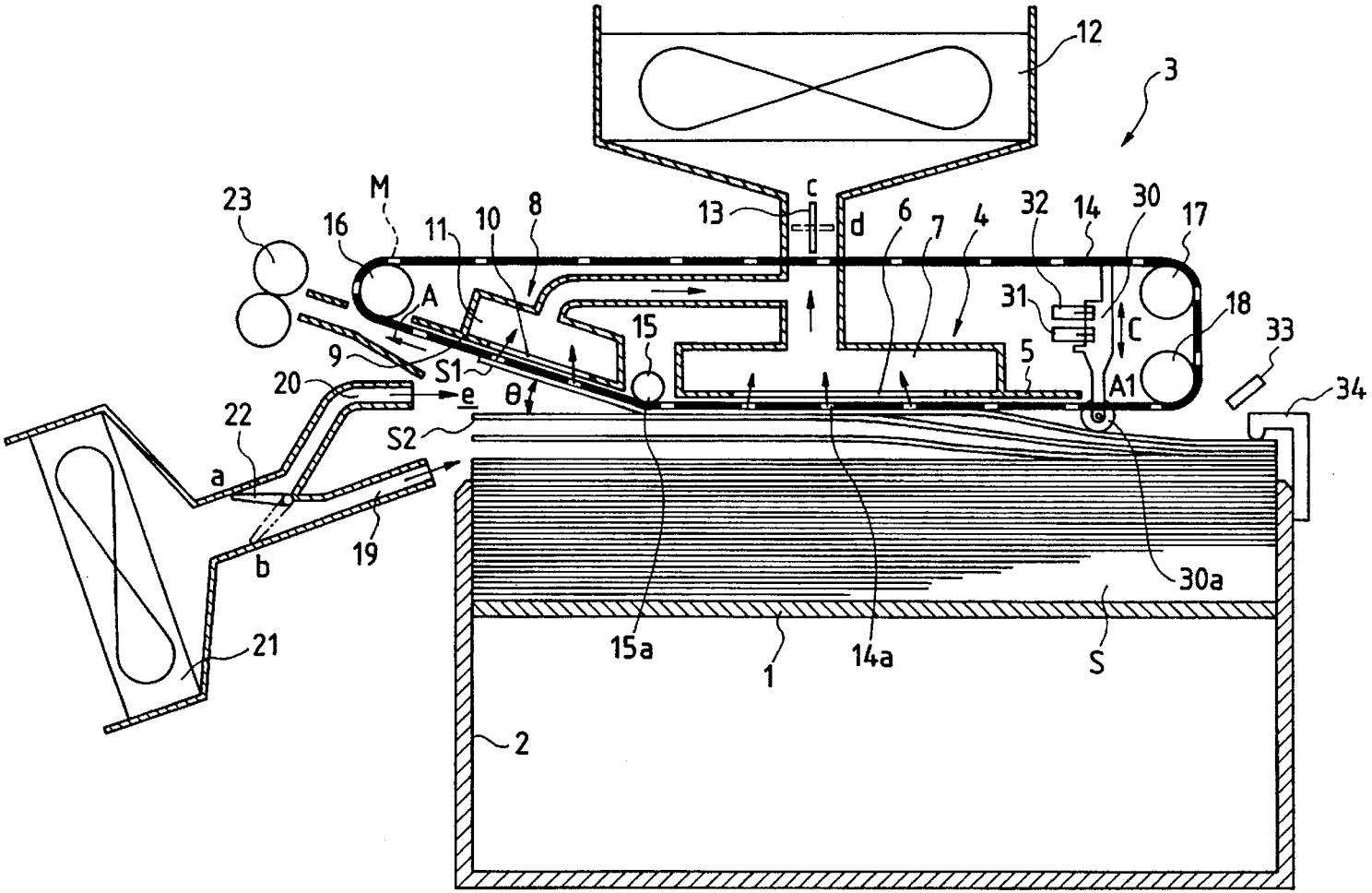
FIG. 7 is a sectional view of a sheet supply apparatus having a sheet feature detecting means according to another embodiment.
Figure 8:
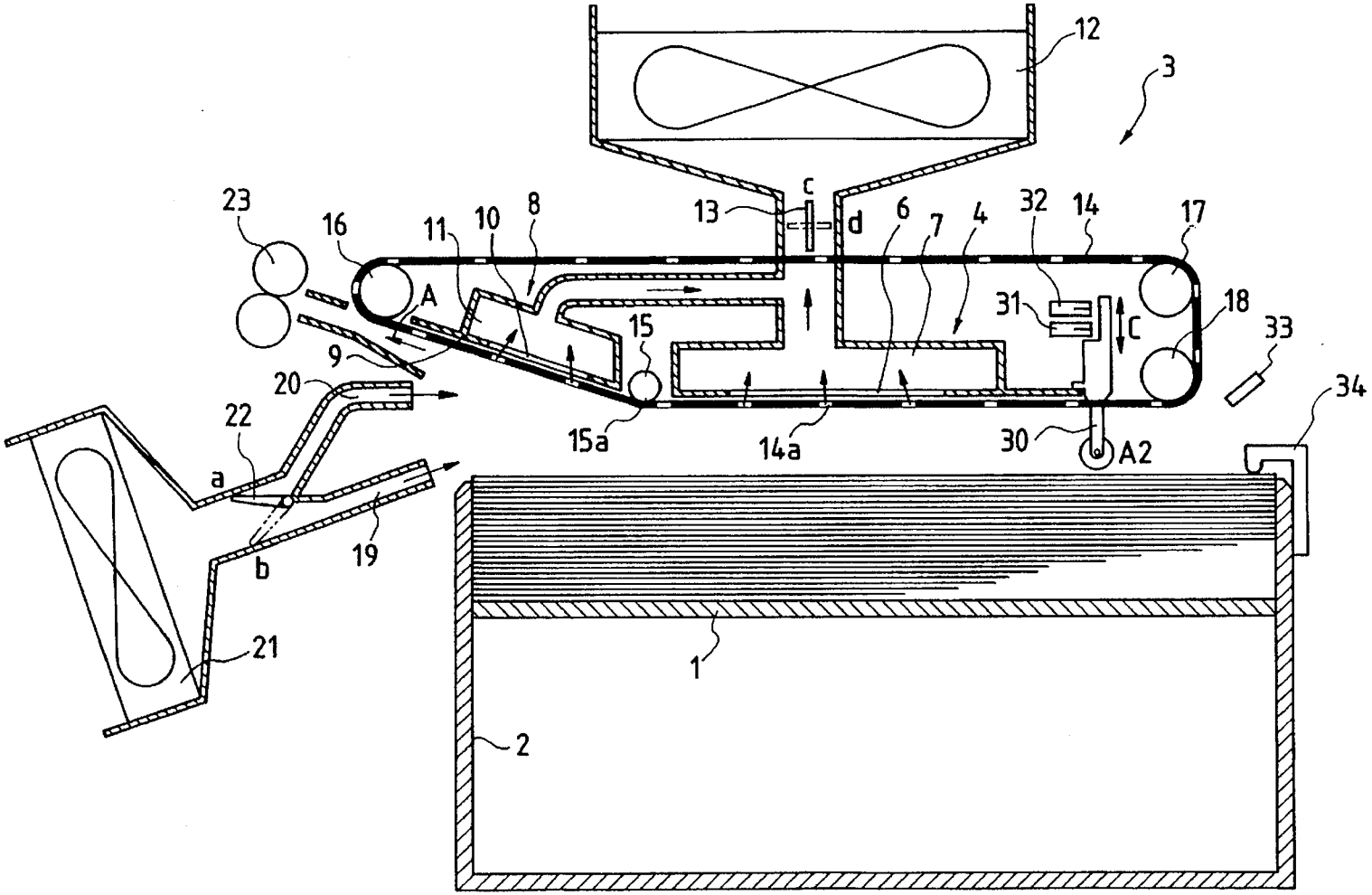
FIG. 8 is a view similar to FIG. 7, showing a waiting condition.
Figure 9:
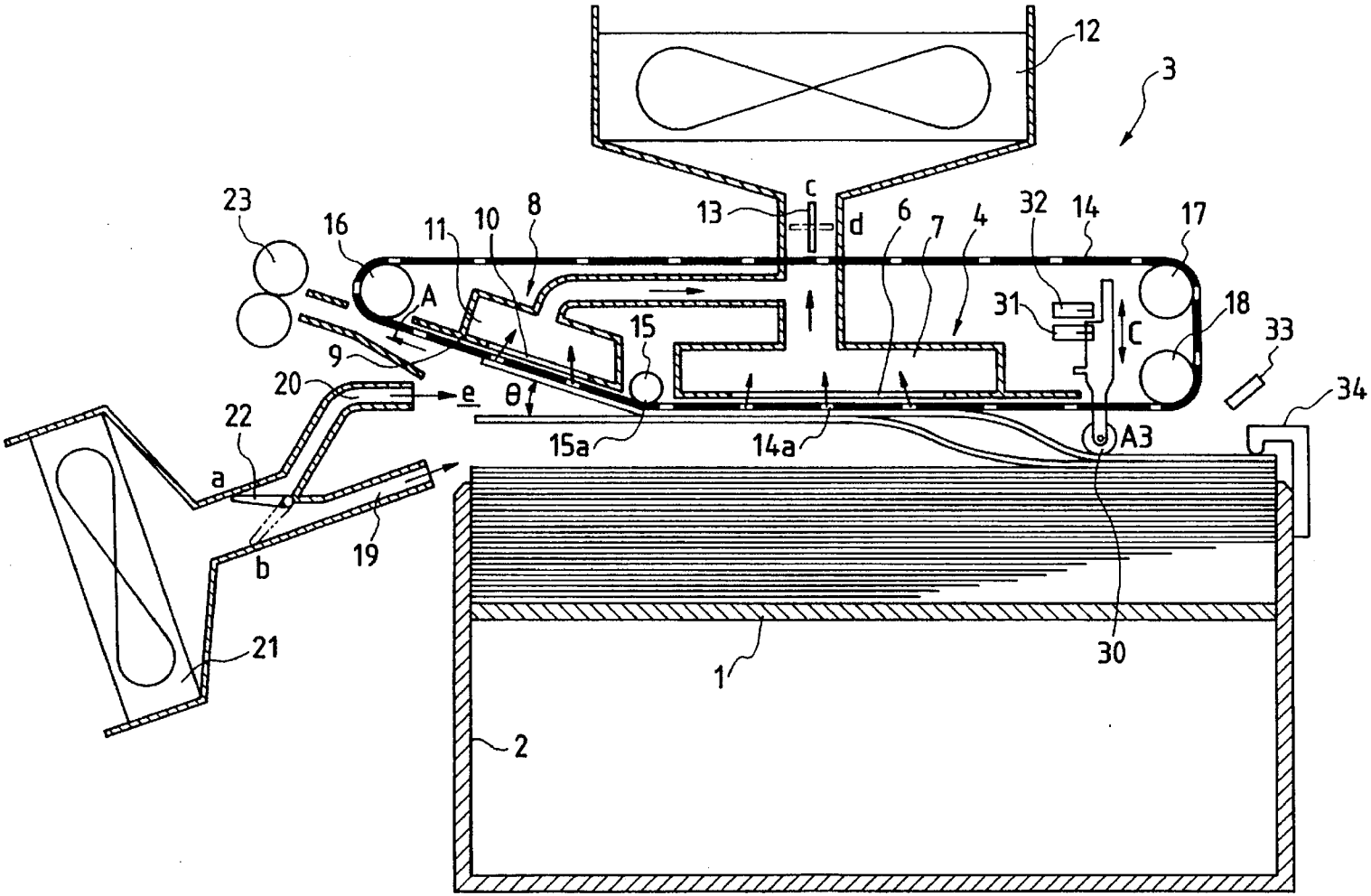
FIG. 9 is a view similar to FIG. 7, showing a sheet supplying condition.

In FIG. 7, a detection member 30 is arranged above a sheet stack rested on a sheet tray 1 and at a downstream side of a first sheet absorb portion 4 in a sheet conveying direction. The detection member is protruded from a first substantially flat bottom surface 5 of the first sheet absorb portion toward the sheet tray 1. The detection member 30 is movable in an up-and-down direction (shown by the arrow C). Photosensors 31, 32 serve to detect a position of the detection member 30 and are switched to ON or OFF when the detection member 30 is lifted or lowered. When the image forming apparatus is not operated, as shown in FIG. 8, the detection member 30 is lowered by its own weight, so that two photo-sensors 31, 32 are turned ON (shown as A2 in FIG. 8). When the detection member 30 is slightly lifted, as shown in FIG. 9, the photo-sensor 31 alone is turned OFF (shown as A3 in FIG. 9); whereas, when the detection member 30 is fully lifted, both the photo-sensors 31, 32 are turned OFF.

Figure 10:
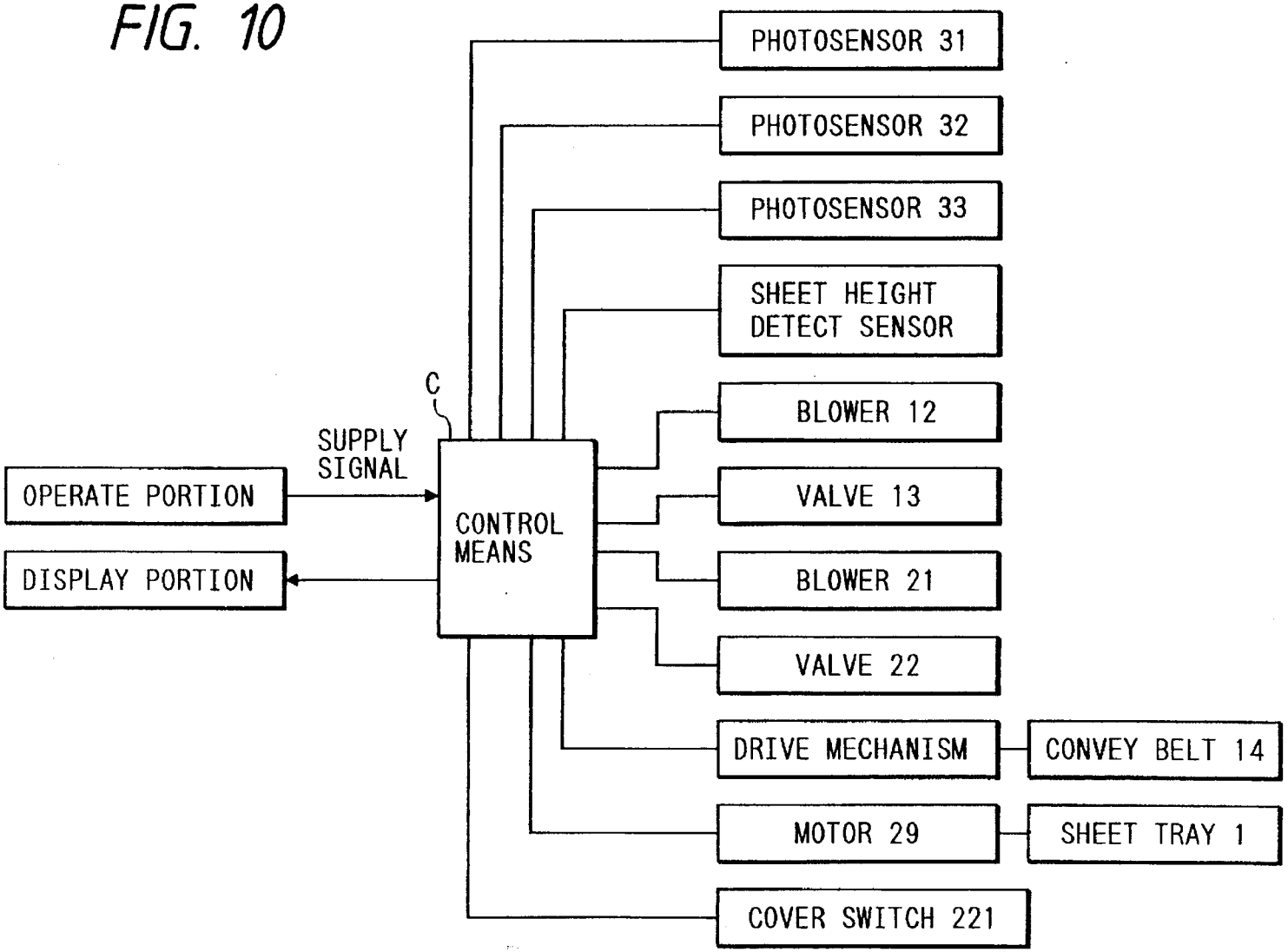
FIG. 10 is a control block diagram of the sheet supply apparatus of FIG. 7.

As shown in FIG. 10, the sheet supply apparatus having the above-mentioned construction is operated by a control means C, as follows.

Figure 11:
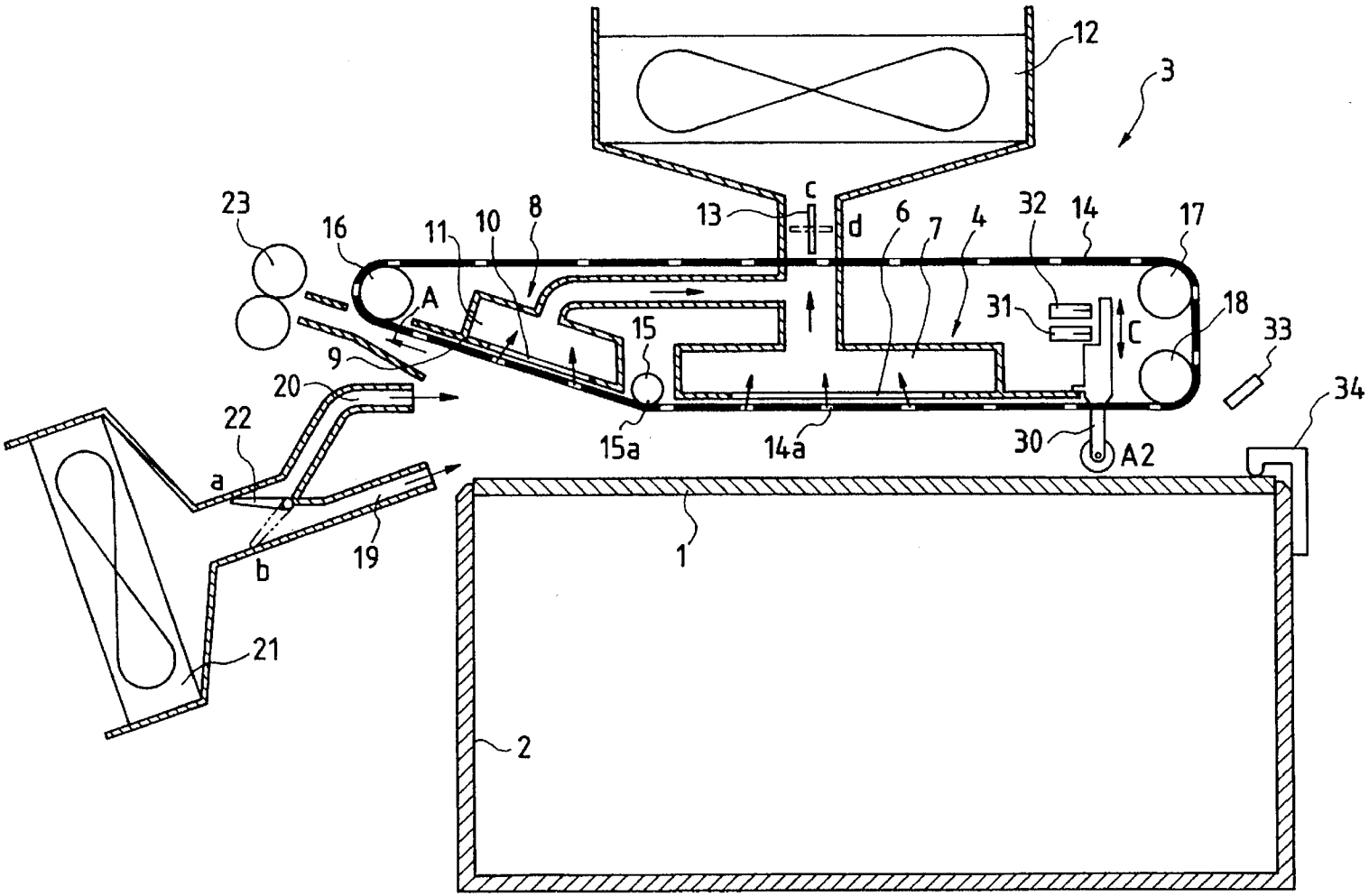
FIG. 11 is a view similar to FIG. 7, showing a sheet empty condition.
Figure 12:
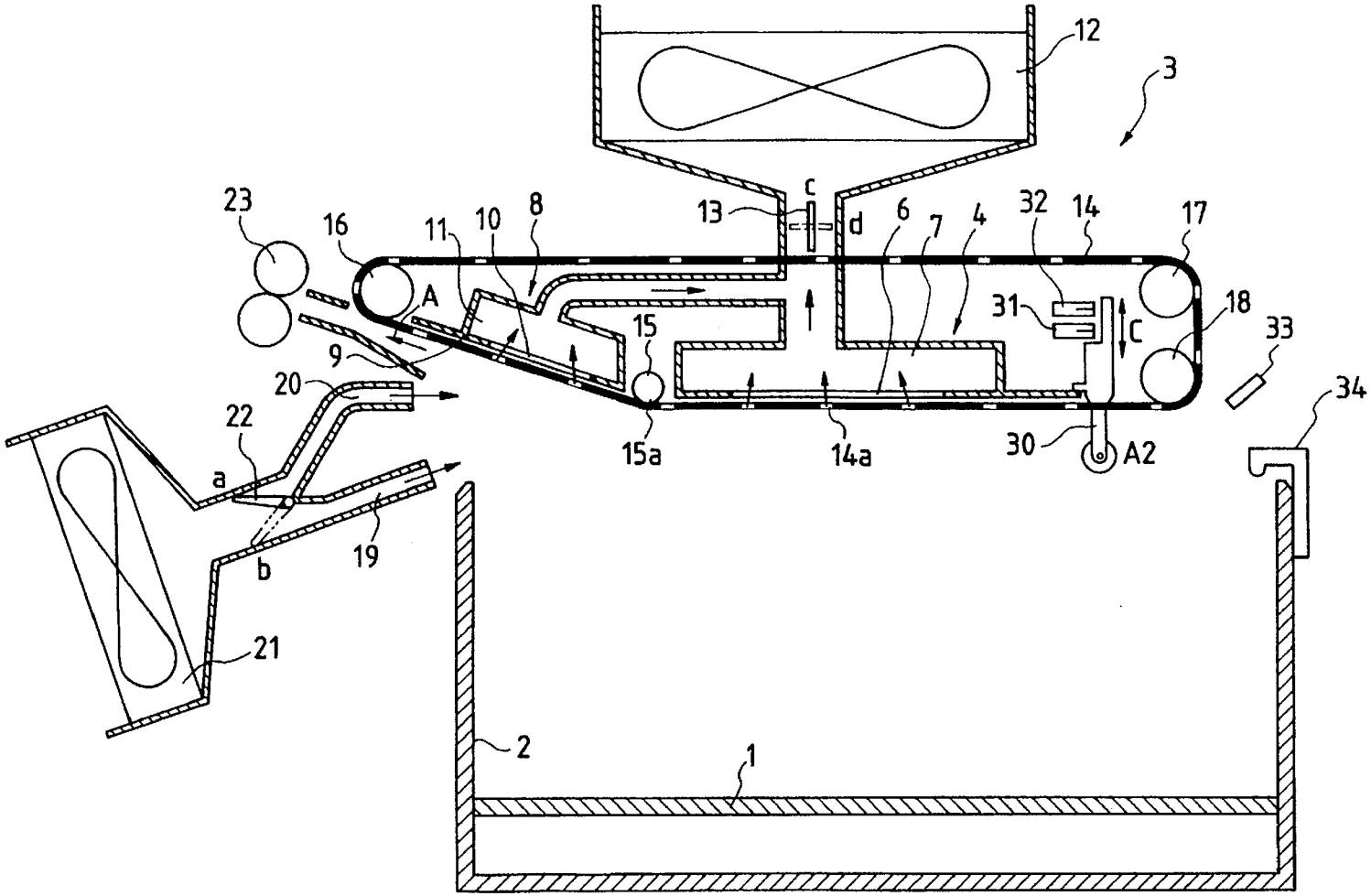
FIG. 12 is a view similar to FIG. 7, showing a sheet replenishing condition.

First of all, as shown in FIG. 11, if it is assumed that the sheet is used up during a predetermined copying operation. This condition is detected by a sheet detection sensor 33 and is displayed on a display portion (refer to FIG. 10). In this condition, to replenish new sheets, a tray color 220 is opened to a position 220B (refer to FIG. 6). Consequently, a cover switch 221 is turned OFF, with the result that the sheet tray 1 is lowered under the action of a motor 29 as shown in FIG. 12 so that the sheet tray is stopped at a second position fur spaced apart from the first sheet absorb portion 4 to permit the replenishment of the new sheets. In this condition, new sheets are replenished. After the replenishing operation, when the tray cover 220 is closed to a position 220A (refer to FIG. 6), the sheet tray 1 is lifted to lift an upper surface of the sheet stack to a first position adjacent to the first sheet absorb portion 4, where a new sheet can be supplied (FIG. 8). When the fact that the position of the upper surface of the sheet stack reaches the first position is detected by a sheet height detection sensor 34, the sheet tray 1 is stopped. At the same time, the sheet feature detecting means is operated.

First of all, when the sheet is not absorbed to the first sheet absorb portion 4, the condition shown in FIG. 8 is maintained. In this condition, the detection member 30 is lowered to the position A2 so that the photo-sensors 31, 32 are both turned ON. After the sheet replenishing operation, when the fact that the sheet stack reaches the first position is detected, similar to the aforementioned sheet supplying operation, the sheet is absorbed to the first and second sheet absorb portions 4, 8.

That is to say, a valve 22 is switched to a position a by means of a switching means such as a solenoid and the like (not shown) to operate a blower 21, thereby injecting air from a nozzle 19 toward a tip end of the sheet stack. As a result, several sheets are floated from the sheet stack. Then, a valve 13 is switched to a position c by a switching means such as a solenoid and the like to operate a blower 12, thereby sucking air through suction openings 6, 10 and suction holes 14*a*. As a result, a first sheet is absorbed to the first and second sheet absorb portions 4, 8 to be closely contacted with the convey belt 14. In this case, while a rear end portion of the sheet positioned at an upstream side of the first sheet absorb portion 4 in the sheet conveying direction is being absorbed to the first sheet absorb portion 4, it tries to follow the flat bottom surface of the first sheet absorb portion 4. However, since the sheet is pushed downwardly by the lowering movement of the detection member 30, the rear end portion of the sheet is stopped at a position where these forces are balanced.

In case of the sheet having small rigidity (thin sheet), since the detection member 30 is stopped at the position A3 (FIG. 9), the photo-sensor 31 is turned OFF by the detection member 30. As a result, the fact that the rigidity of the sheet is small (thin sheet) is displayed on the display portion.

In case of the sheet having great rigidity (thick sheet), since the detection member 30 is adequately lifted by the sheet and stopped at the position A1 (FIG. 7), the photo-sensors 31, 32 are both turned OFF. As a result, the fact that the rigidity of the sheet is great (thick sheet) is displayed on the display portion. After the display, the air is turned OFF to stop the suction forces, thereby returning the normal sheet supplying condition.

In this way, when the rigidity of the sheet is changed in accordance with the kinds of sheets, a position where the above two forces are balanced is changed. That is to say, the position to which the detection member 30 is to be shifted is changed, and, thus, it is possible to detect the rigidity of the sheet by measuring the shifted amount of the detection member 30. By displaying a detected result, the user or service man can correctly understand the rigidity of the sheet, so that optimum copying conditions such as transfer voltage, air absorbing force, fixing temperature and the like can be set.

Figure 13:
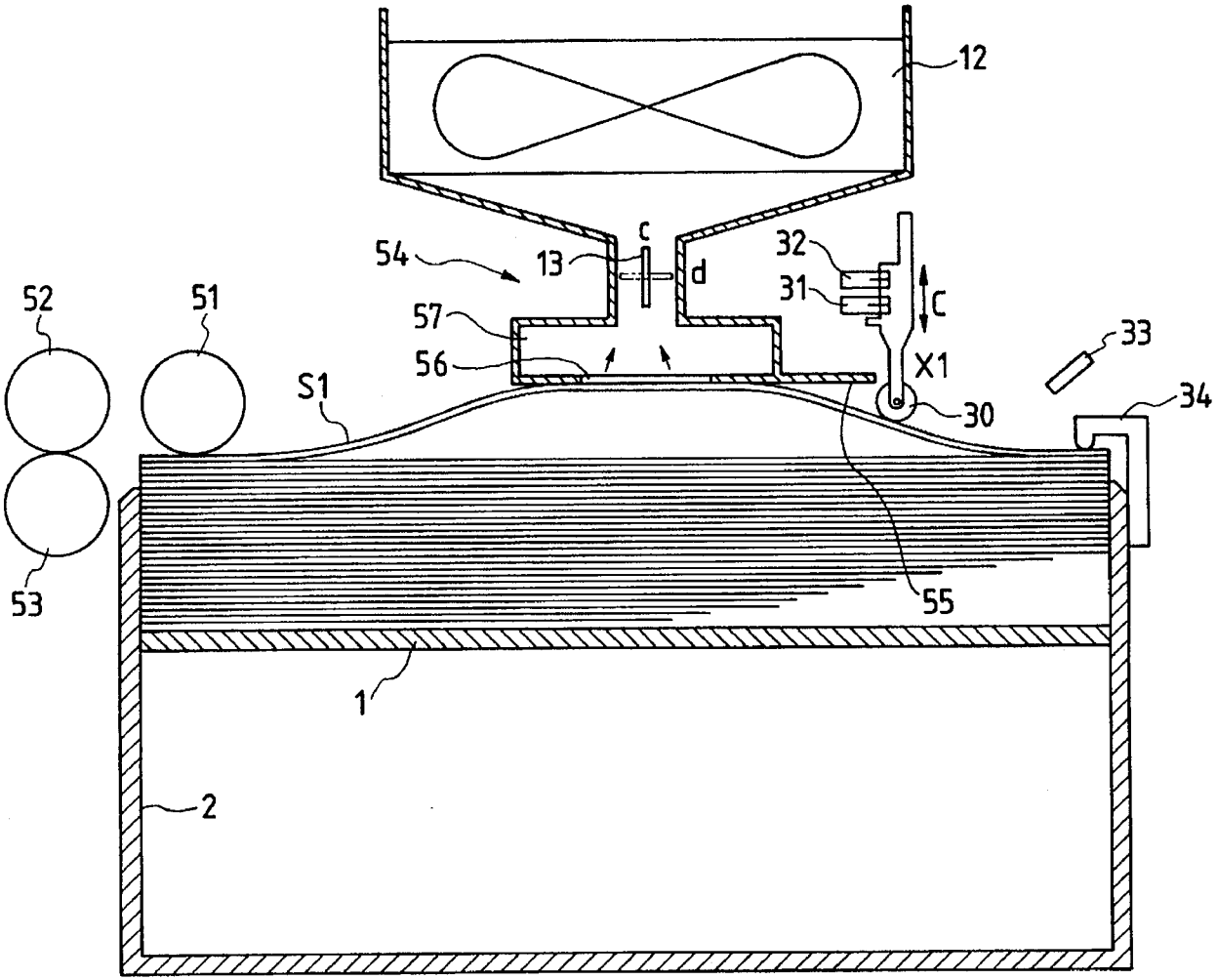
FIG. 13 is a sectional view showing an example that the sheet feature detecting means used with the sheet supply apparatus of FIG. 7 is applied to another sheet supply apparatus.
Figure 14:
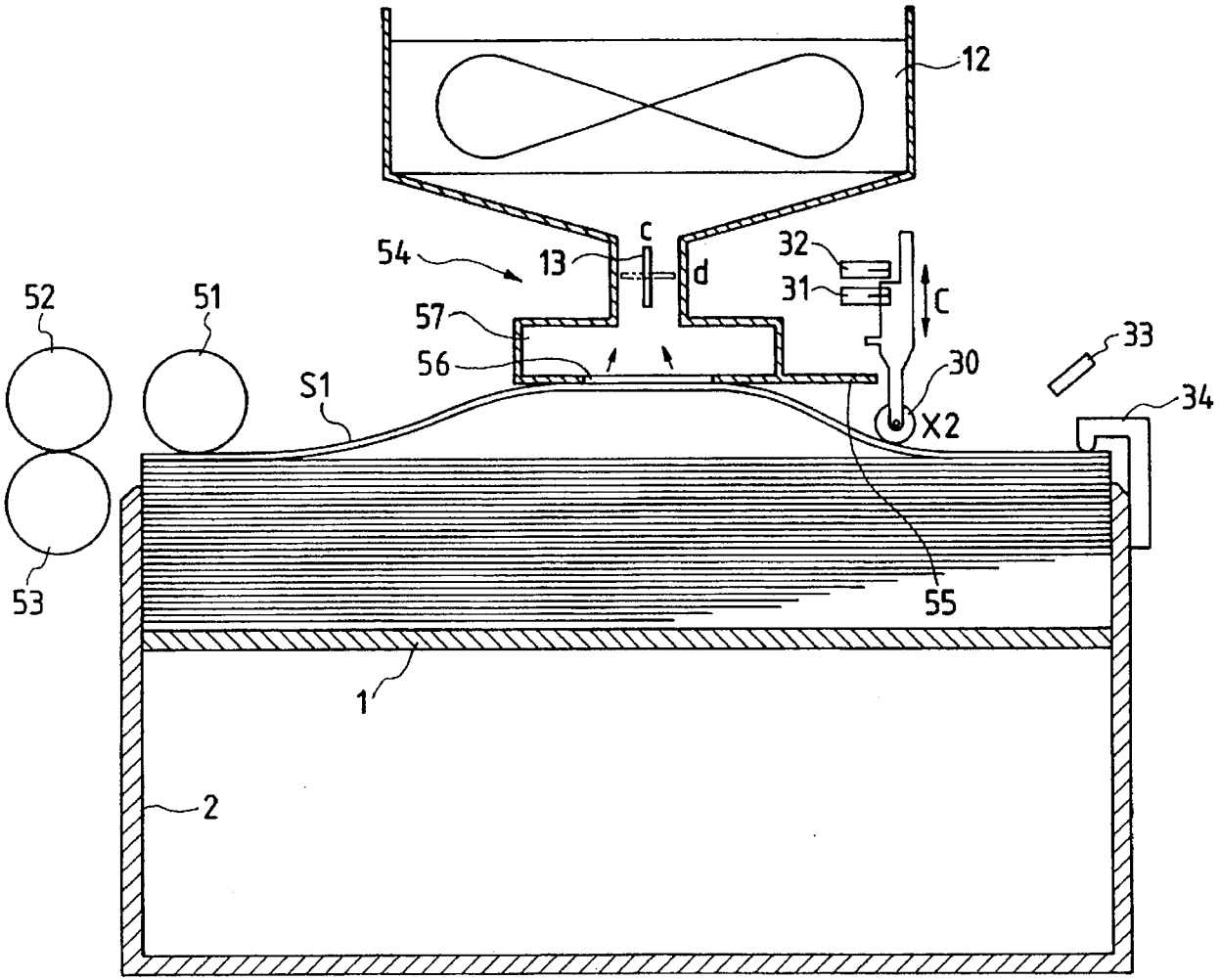
FIG. 14 is a view showing an operating condition of the sheet supply apparatus of FIG. 13.

Next, FIGS. 13 and 14 show a sheet supply apparatus of roller supply type into which a sheet feature detecting means is incorporated. FIG. 13 is a schematic sectional view of the sheet supply apparatus according to this embodiment, and FIG. 14 is also a schematic sectional view of the sheet supply apparatus showing another condition. Incidentally, the same elements as those shown in the above embodiment are designated by the same reference numerals and explanation thereof will be omitted.

The sheet supply apparatus comprises a pick-up roller 51 for picking up a single sheet from a sheet stack, a feed roller 52 for conveying the sheet received from the pick-up roller 51, and a retard roller 53 for separating the sheet from the other sheets. A sheet absorb portion 54 comprises a substantially flat bottom surface 55 opposed to the sheet stack rested on a sheet tray 1, an air suction opening 56 formed in the substantially flat bottom surface 55, and a suction chamber 57.

An operation for detecting rigidity of the sheet is substantially the same as the aforementioned one.

First of all, it is assumed that the sheet is used up during the predetermined copying operation. This condition is detected by a sheet detection sensor 33 of light reflection type and is displayed on a display portion. To replenish new sheets, a tray cover 220 is opened to a position 220B (FIG. 6). Consequently, a cover switch 221 is turned OFF, with the result that the sheet tray 1 is lowered under the action of a motor (not shown) so that the sheet tray is stopped at a second position fur spaced apart from the sheet absorb portion 54 to permit the replenishment of the sheets. In this condition, new sheets are replenished. After the replenishing operation is finished, when the tray cover 220 is closed to a position 220A, the sheet tray 1 is lifted to lift an upper surface of the sheet stack to a position where a new sheet can be supplied. When the fact that the position of the upper surface of the sheet stack reaches a predetermined position (first position) adjacent to the sheet absorb portion 54 is detected by a sheet height detection sensor 34, the sheet tray 1 is stopped. At the same time, the sheet feature detecting means is operated.

That is to say, a valve 13 is switched to a position c by means of a switching means such as a solenoid and the like (not shown) to operate a blower 12, thereby sucking the air through the suction opening 56. As a result, an uppermost sheet S1 is absorbed to the sheet absorb portion 54 to be closely contacted with the substantially flat bottom surface 55. In this case, as is in the aforementioned embodiment, in case of the sheet having small rigidity (thin sheet), since the detection member 30 is lifted to a position X2 (FIG. 14), the photo-sensor 31 is turned OFF by the detection member 30. As a result, the fact that the rigidity of the sheet is small (thin sheet) is displayed on the display portion. In case of the sheet having great rigidity (thick sheet), since the detection member 30 is lifted to a position X1 (FIG. 13), the photo-sensors 31, 32 are both turned OFF. As a result, the fact that the rigidity of the sheet is great (thick sheet) is displayed on the display portion. After the display, the air is turned OFF to stop the suction force, thereby returning the normal sheet supplying condition.

By displaying a detected result, the user or service man can correctly understand the rigidity of the sheet, so that optimum copying conditions such as transfer voltage, retard pressure of the retard roller in the sheet supply, fixing temperature and the like can be set.

Incidentally, in the illustrated embodiment, while an example that a two-stage shifting movement of the detection member 30 is measured or detected was explained, the present invention is not limined to such an example. For example, a multi-stage shifting movement of the detection member or a stageless shifting movement of the detection member may be measured by using a slide volume and the like.

Further, in the illustrated embodiment, while an example that the detection member is lowered by its own weight was explained, the present invention is not limited to such an example, but, any force directing to a direction opposite to the sheet absorbing direction may be applied to the detection member by using a spring and the like, for instance. Further, in the illustrated embodiment, while an example that the rigidity of the sheet is detected at the rear end portion of the sheet was explained, the present invention is not limited to such an example, but, the rigidity of the sheet may be detected at a front end portion or a side portion of the sheet. Furthermore, in the illustrated embodiments, while an example that the sheets can be replenished by opening and closing the cover was explained, the present invention is not limited to such an example, but, the sheet tray may be of floating type wherein the entire sheet tray is retracted from the image forming apparatus toward this side to replenish new sheets. Further, after sheets are contained in a cassette, the cassette may be inserted into the image forming apparatus.

Next, a sheet feature detecting means according to a further embodiment will be explained with reference to FIGS. 15 to 20.

A first detection means 150 is arranged in the proximity of the first sheet absorb portion 4. A detection arm 151 is rotatably mounted around a fulcrum 152. The detection arm 151 is positioned to a position f protruded from the first sheet absorb portion 4 when the sheet is not absorbed to the first sheet absorb portion. When the sheet is absorbed to the first sheet absorb portion, the detection arm 151 is urged by the sheet to rotate around the fulcrum 152 to reach a position g. At this position, the detection arm is detected by a photo-sensor 153, thereby judging that the sheet is absorbed.

A second detection means 160 is arranged in the proximity of the second sheet absorb portion 8. A detection arm 161 is rotatably mounted around a fulcrum 162. The detection arm 161 is positioned to a position h protruded from the second sheet absorb portion 8 when the sheet is not absorbed to the second sheet absorb portion. When the sheet is absorbed to the second sheet absorb portion, the detection arm 161 is urged by the sheet to rotate around the fulcrum 162 to reach a position g. At this position, the detection arm is detected by a photo-sensor 163, thereby judging that the sheet is absorbed.

Figure 15:
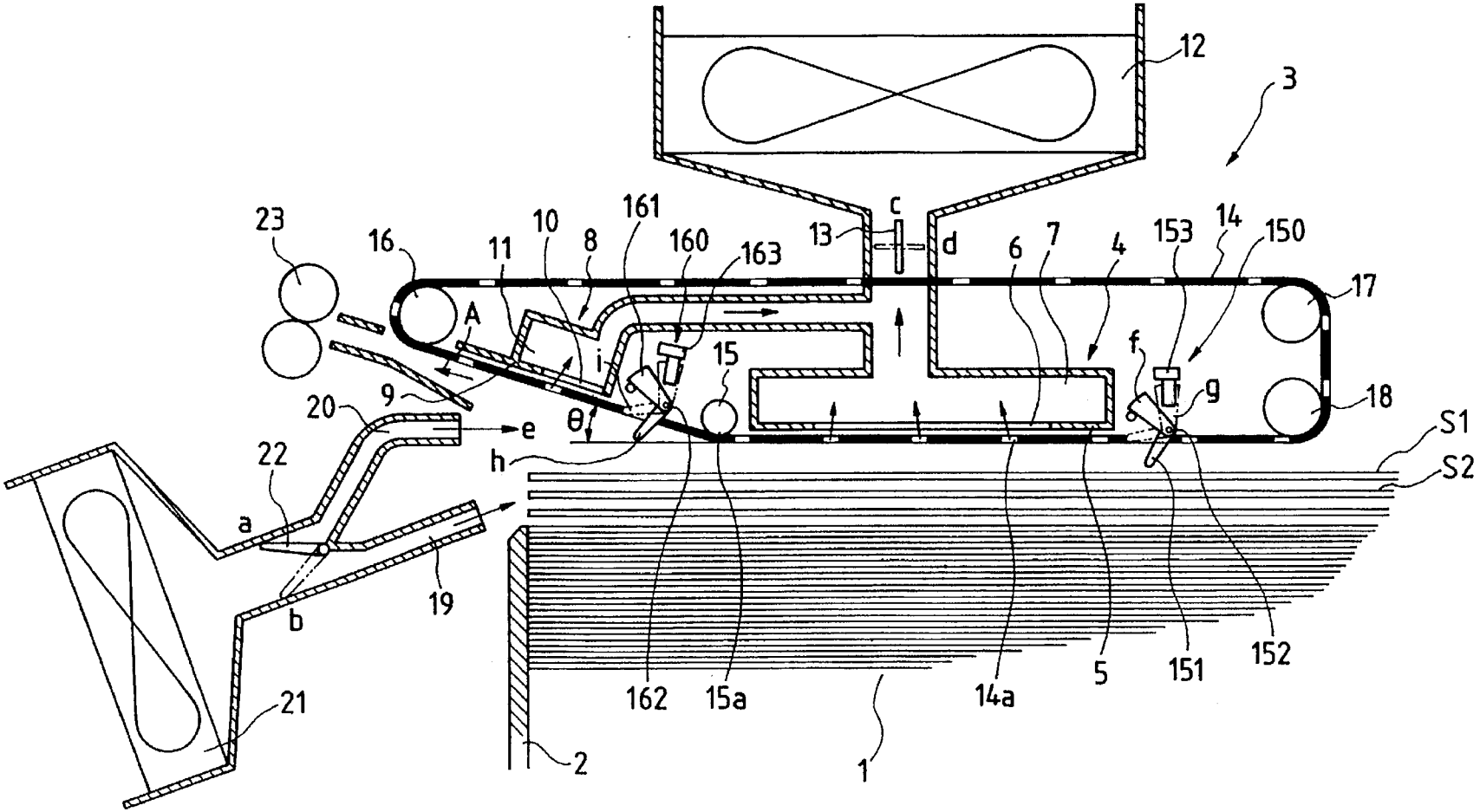
FIG. 15 is a sectional view of a sheet supply apparatus having a sheet feature detecting means according to a further embodiment.
Figure 16:
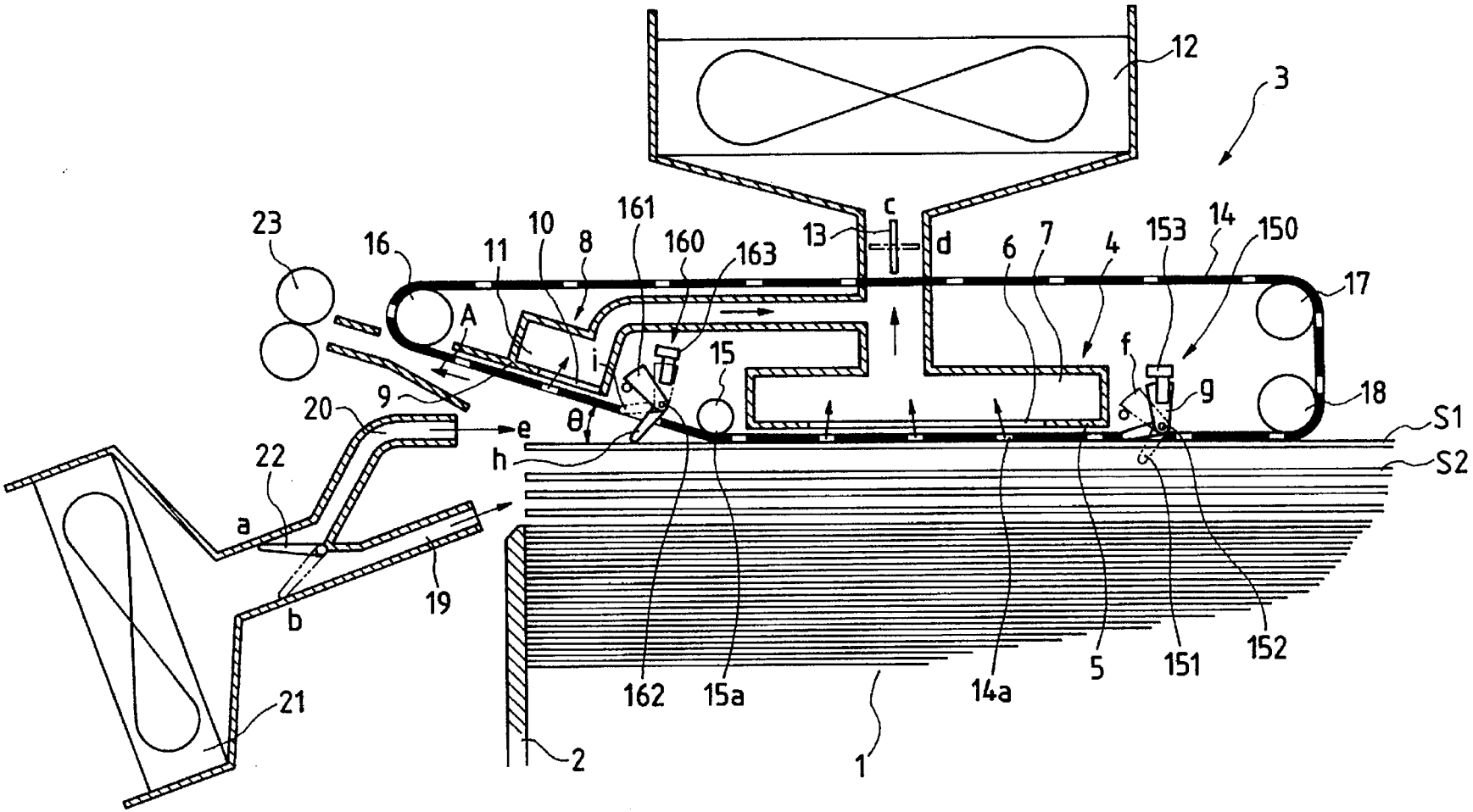
FIGS. 16 and 17 are views showing a sheet absorbing operation of the sheet supply apparatus of FIG. 15.
Figure 20:
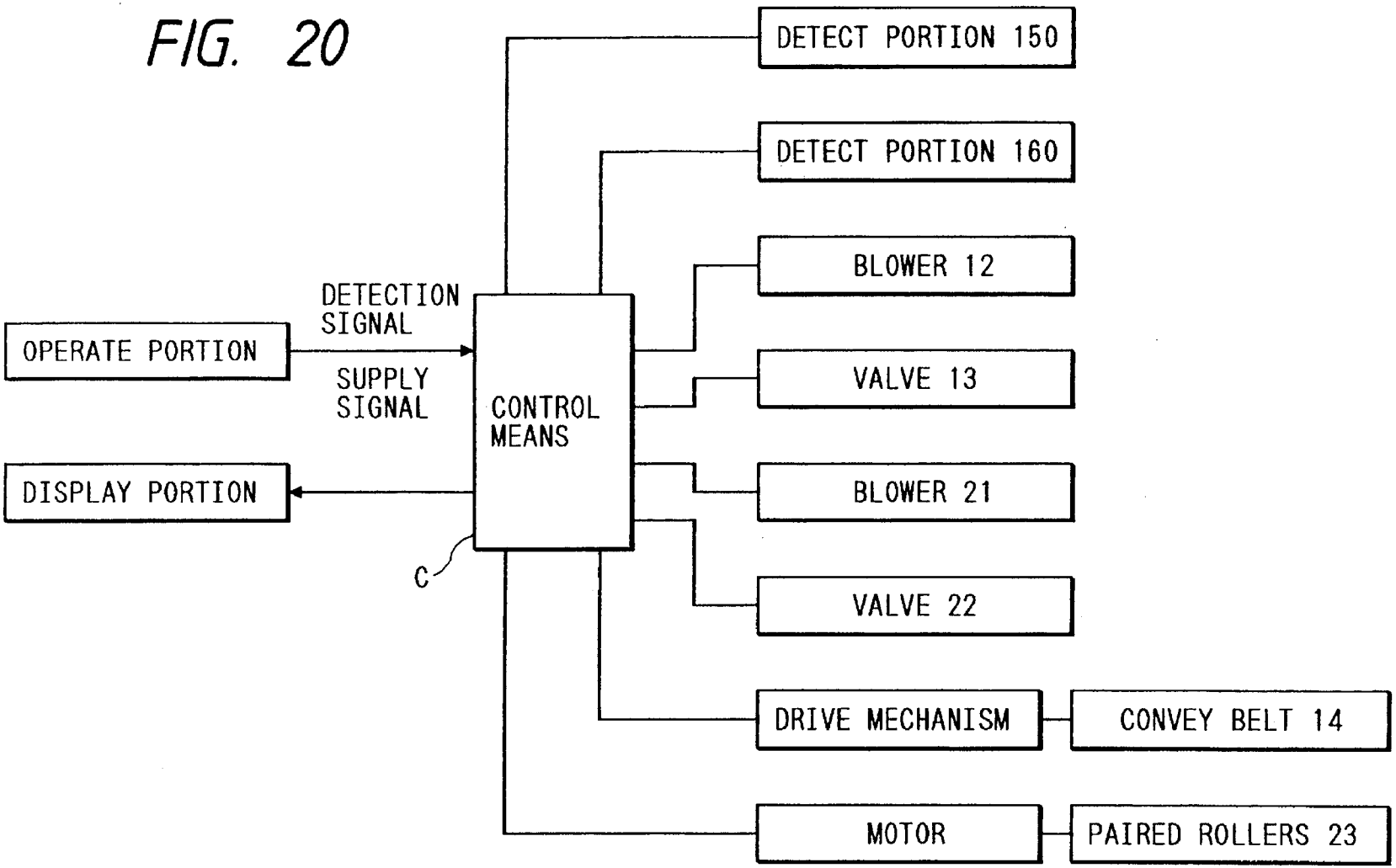
FIG. 20 is a control block diagram of the sheet supply apparatus of FIG. 15.

Next, an operation of this embodiment will be explained with reference to FIGS. 15 to 17, a timing chart shown in FIG. 18 and a black diagram shown in FIG. 20.

First of all, when a detection start button (not shown) is depressed, the blower 21 is operated, and the valve 22 is swtiched to the position a by the switching means such as the solenoid (not shown), thereby injecting the air from the nozzle 19 toward the tip end of the sheet stack. Consequently, several sheets are floated from the sheet stack. Then, the blower 12 is operated and the valve 13 is switched to the position c by the switching means such as the solenoid, thereby sucking the air through the suction openings 6, 10 and the suction holes 14*a*.

As a result, since the first sheet absorb portion 4 is nearer the sheet than the second sheet absorb portion 8, the uppermost sheet S1 is firstly absorbed to the first sheet absorb portion 4 to be closely contacted with the convey belt 14. More particularly, as shown in FIG. 16, a central portion of the sheet is absorbed to the first sheet absorb portion 4. Consequently, as mentioned above, the detection arm 151 is urged by the sheet to reach the position g. This condition is detected by the photo-sensor 153, with the result that the first detection means 150 judges that the sheet is absorbed.

Figure 17:
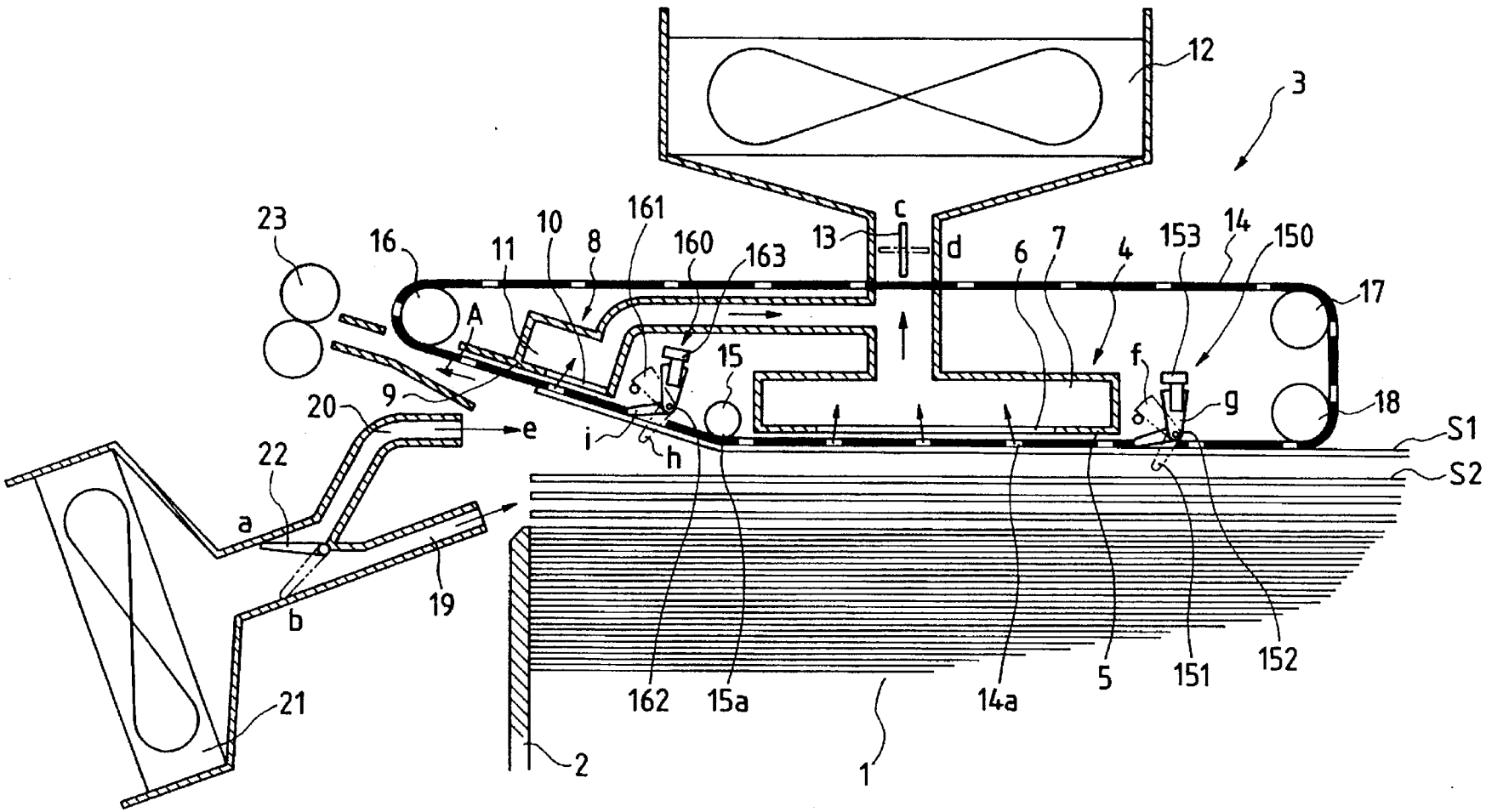
Figure 18:
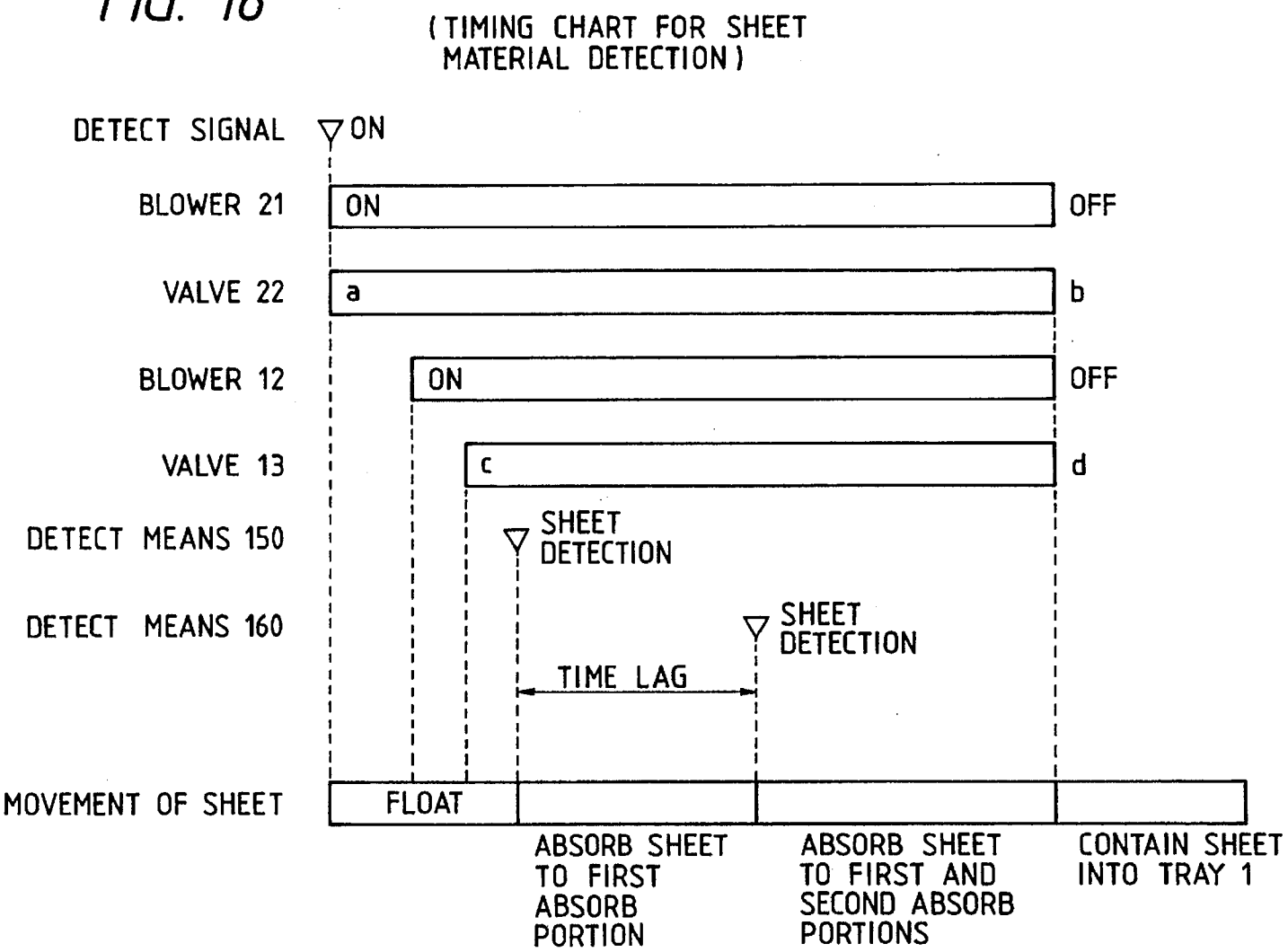
FIG. 18 is a timing chart for detecting a sheet feature in the sheet supply apparatus of FIG. 15.
Figure 19:
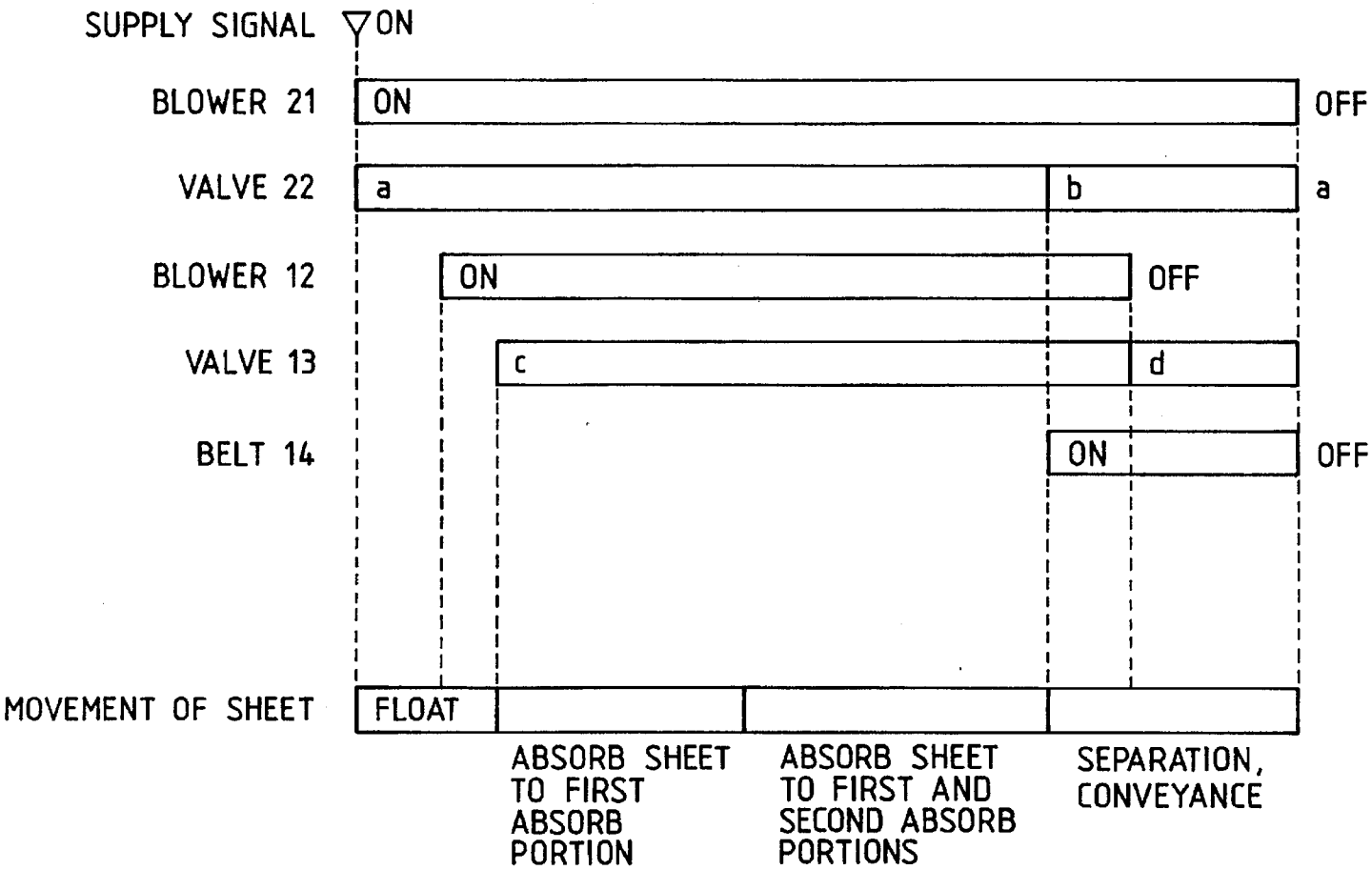
FIG. 19 is a sheet supply timing chart of the sheet supply apparatus of FIG. 15.

Then, the tip end portion of the sheet is absorbed to the second sheet absorb portion 8 (FIG. 17). In this case, since the absorbing forces of the first and second sheet absorb portions are set to be sufficiently strong, the sheet is deformed around the displacement fulcrum 15*a* in opposition to the rigidity of the sheet, so that the tip end portion of the sheet is closely contacted with the second sheet absorb portion. That is to say, the sheet S1 follows the substantially flat bottom surfaces 5, 9 and is deformed around the displacement fulcrum 15*a* in a downwardly convex L-shaped configuration. As a result, as mentioned above, the detection arm 161 is urged by the sheet to reach a position i. This condition is detected by the photo-sensor 163, with the result that the second detection means 160 judges that the sheet is absorbed.

In this way, there is a time lag after the sheet is absorbed to the first sheet absorb portion 4 and before the sheet is absorbed to the second sheet absorb portion 8. The time lag is changed depending upon the kind (feature) of the sheet. For example, the sheet having small rigidity (thin sheet) is apt to be deformed around the displacement fulcrum 15*a* and be absorbed to the second sheet absorb portion 8 immediately. Thus, the time lag becomes small.

To the contrary, since the sheet having great rigidity (thick sheet) is hard to be deformed around the displacement fulcrum 15*a* and be absorbed to the second sheet absorb portion 8 gradually, the time lag becomes great. Thus, by measuring the time lag by means of a measuring means (not shown), the kind (feature) of the sheet, particularly, the rigidity of the sheet can be judged. The rigidity of the sheet is displayed on a display device (not shown). By displaying the rigidity in this way, the user and service man can correctly set the optimum conditions for the sheet, such as transfer current, air absorbing force in the sheet supply, fixing temperature and the like.

Thereafter, the blower 12 is stopped, the valve 13 is returned to the position d, the blower 21 is stopped and the valve 22 is returned to the position b, thereby returning the other sheets onto the sheet tray 1.

In the aforementioned embodiment, while the sheet feature detecting means was explained, t such a detecting means can be applied to a sheet supply apparatus of an image forming apparatus. Such an image forming apparatus will now be explained with reference to FIGS. 15 to 17, the timing chart shown in FIG. 18 and the black diagram shown in FIG. 20. Incidentally, the construction of the image forming apparatus is as mentioned previously.

Now, although the operation of the apparatus will be explained, since the operations that the sheet is absorbed to the first and second sheet absorb portions 4, 8, the feature of the sheet is detected and displayed and the optimum conditions are set are already explained, explanation thereof will be omitted.

Thereafter, when a copy start button (not shown) on an operation portion is depressed, similar to the above explanation, the sheet is absorbed to the first and second sheet absorb portions 4, 8. In this case, it is assumed that the second sheet S2 is closely contacted with the first sheet S1. In such a case, a central portion of the second sheet S2 substantially follows the first sheet S1. However, since the surface of the second sheet absorb portion 8 is covered by the sheet S1, the absorbing force does not act on the tip end portion of the sheet S2. Accordingly, in accordance with the rigidity of the sheet, the sheet S2 is not deformed around the displacement fulcrum 15*a* to keep a flat condition, with the result that the tip end portion of the second sheet S2 is separated from the tip end portion of the first sheet S1 to create a gap e therebetween.

Thereafter, the convey belt 14 is driven by the drive means 58 to convey the sheet S1 in the direction shown by the arrow A. At the same time, the valve 22 is switched to the position b and the air is injected from the nozzle 20 toward the gap e between the sheets S1, S2, thereby separating the entire sheet S2 from the sheet S1 stably.

Accordingly, the sheet S1 alone is conveyed downstreamly to reach the pair of convey rollers 23. After the predetermined time is elapsed (i.e. after the sheet is pinched between the convey rollers 23), the blower 12 is stopped and the valve 13 is switched to the position d. Further, after the predetermined time is elapsed (i.e. after the sheet leaves the pair of convey rollers 23), the blower 21 is stopped and the convey belt 14 is also stopped, thereby completing the sheet conveyance.

Next, a sheet supply apparatus having a mechanism for detecting the rigidity of the sheet by using the sheet feature detecting means shown in FIG. 1 and for separating and supplying the sheet properly on the basis of a detection result will be explained.

First of all, a mechanism for changing an angle θ between the first and second sheet absorb portions 4, 8 in accordance with the rigidity of the sheet will be described. An angle adjustment shaft supporting plate 75 through which shaft of rollers 15, 16 extend is rotatably mounted on the shaft of the roller 15. An angle adjustment arm 176 is rotatably attached to the angle adjustment shaft supporting plate 175 and to a rack 177 which is meshed with a pinion gear 179*a* to be shifted in a direction shown by the arrow B. The pinion gear 179*a* is rotated by a motor 179. Incidentally, a roller 17 is slidably mounted so that it is pulled outwardly by a spring 174 with a predetermined force. With this arrangement, the convey belt 14 is mounted around the rollers with constant tension.

Such an arrangement serves to set the angle to satisfy the following two conditions in accordance with the sheet to be conveyed. The first condition is to completely absorb the uppermost sheet S1 alone to the second sheet absorb portion 8, and the second condition is that, when the second sheet S2 is absorbed together with the first sheet S1, the rigidity of the sheet is greater than a force by which the second sheet is deformed around the displacement fulcrum 15*a* in a downwardly convex shape.

Figure 21:
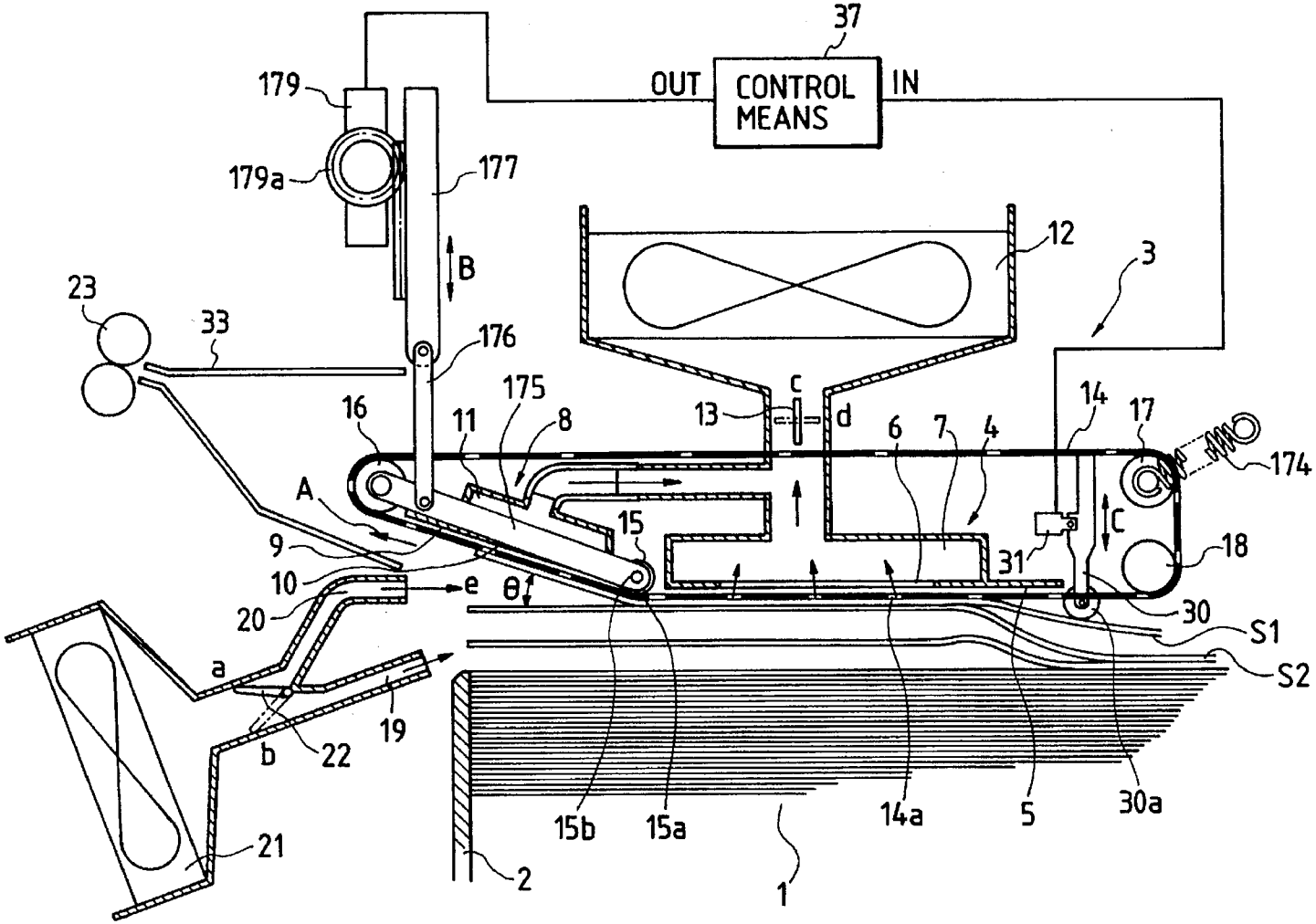
FIG. 21 is a sectional view of a sheet supply apparatus having a mechanism for controlling separation of sheet on the basis of a detection result from a sheet feature detecting means.

In case of the sheet having great resiliency, the operation of the air sheet supply apparatus will be explained with reference to FIG. 21. The valve 22 is switched to the position a by the switching means such as the solenoid (not shown) and the blower 21 is operated, thereby injecting the air from the nozzle 19 toward the tip end of the sheet stack. As a result, several sheets are floated from the sheet stack. Then, the valve 13 is switched to the position c by the switching means such as the solenoid and the blower 12 is operated, thereby sucking the air through the suction openings 6, 10 and the suction holes 14*a*.

As a result, the uppermost sheet S1 is absorbed to the first and second sheet absorb portions 4, 8 and is closely contacted with the convey belt 14. More specifically, as shown in FIG. 21, a central portion and a rear end portion of the sheet are absorbed to the first sheet absorb portion 4 and a tip end portion of the sheet is absorbed to the second sheet absorb portion 8. Although the detection member 30 is subjected to the downwardly directing force by its own weight, since the rigidity of the sheet is great, the rear end portion of the sheet is not lowered greatly from the flat bottom surface 5, with the result that the detection member 30 is pushed up by the sheet, thereby turning the photo-sensor 31 ON.

If the angle θ is great, since the first sheet S1 is stabilized not to be absorbed to the second sheet absorb portion 8, the angle θ must be reduced. To do so, when the control means 37 received the ON signal from the photo-sensor, the control means activates the motor 179 to lower the rack 177 via the pinion gear 179*a*, thereby setting the angle θ to the aforementioned angle.

Consequently, the sheet is deformed around the displacement fulcrum 15*a* in opposition to the rigidity of the sheet, with the result that the tip end portion and the central portion of the sheet are both closely contacted with the convey belt 14. That is to say, the sheet S1 follows the flat bottom surfaces 5, 9 and is deformed around the displacement fulcrum 15*a* in a downwardly convex L-shaped configuration. In this case, it is assumed that the second sheet S2 is closely contacted with the first sheet S1. In such a case, since the angle θ was previously set to the aforementioned angle, the second sheet S2 is not deformed around the displacement fulcrum 15*a* to keep the flat condition, thereby separating the tip end of the second sheet from the sheet to create the gap e therebetween.

Thereafter, the convey belt 14 is driven by the drive means (not shown) to convey the sheet S1 in the direction shown by the arrow A. At the same time, the valve 22 is switched to the position b and the air is injected from the nozzle 20 toward the gap a between the sheets S1, S2, thereby separating the sheet S2 from the sheet S1 stably. Accordingly, the sheet S1 alone is conveyed downstreamly to reach the pair of convey rollers 23. Then, the image is formed on the sheet S1 by the image forming means.

Figure 22:
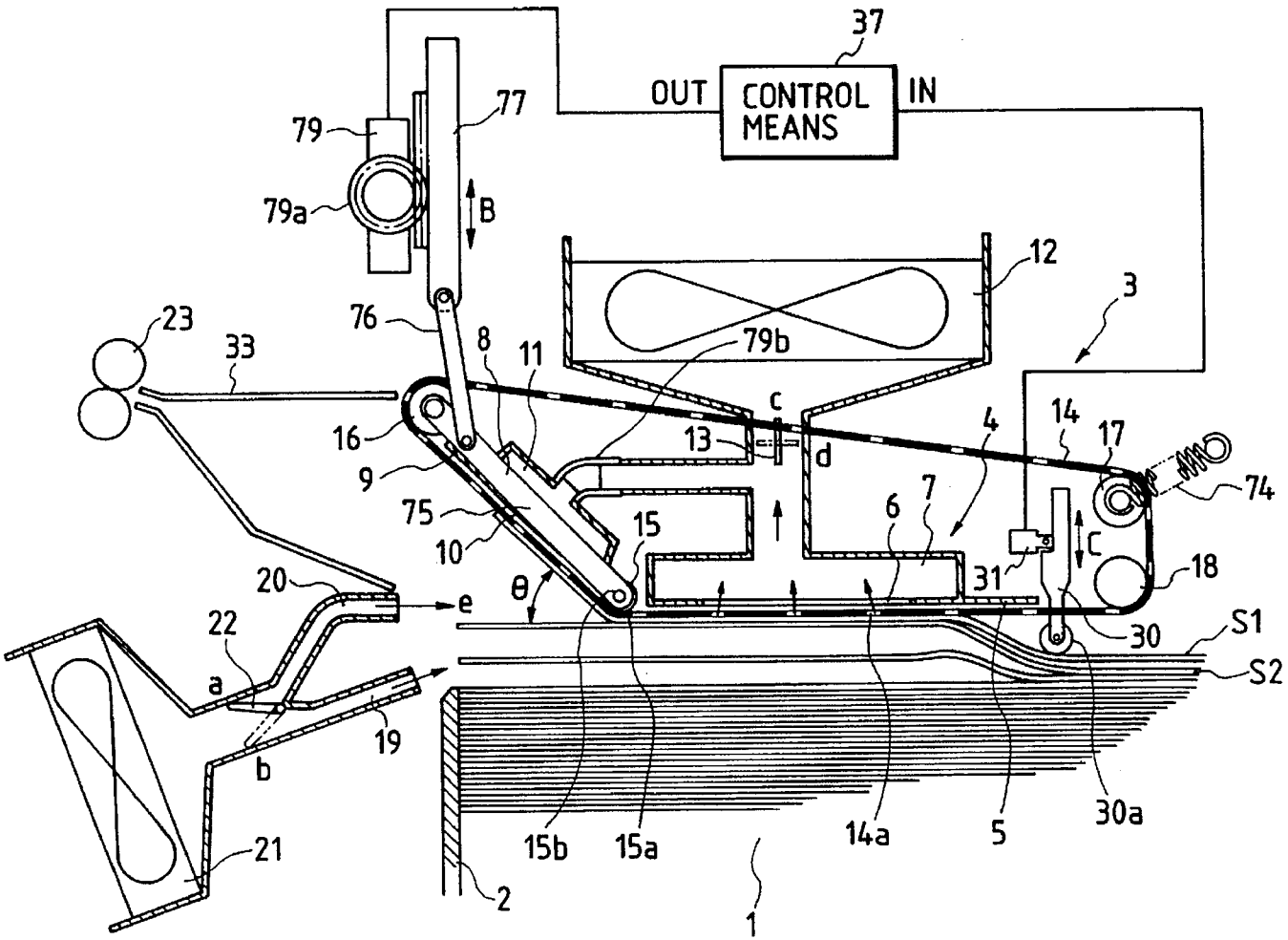
FIG. 22 is a view showing an operation of the sheet supply apparatus of FIG. 21.
Figure 23:
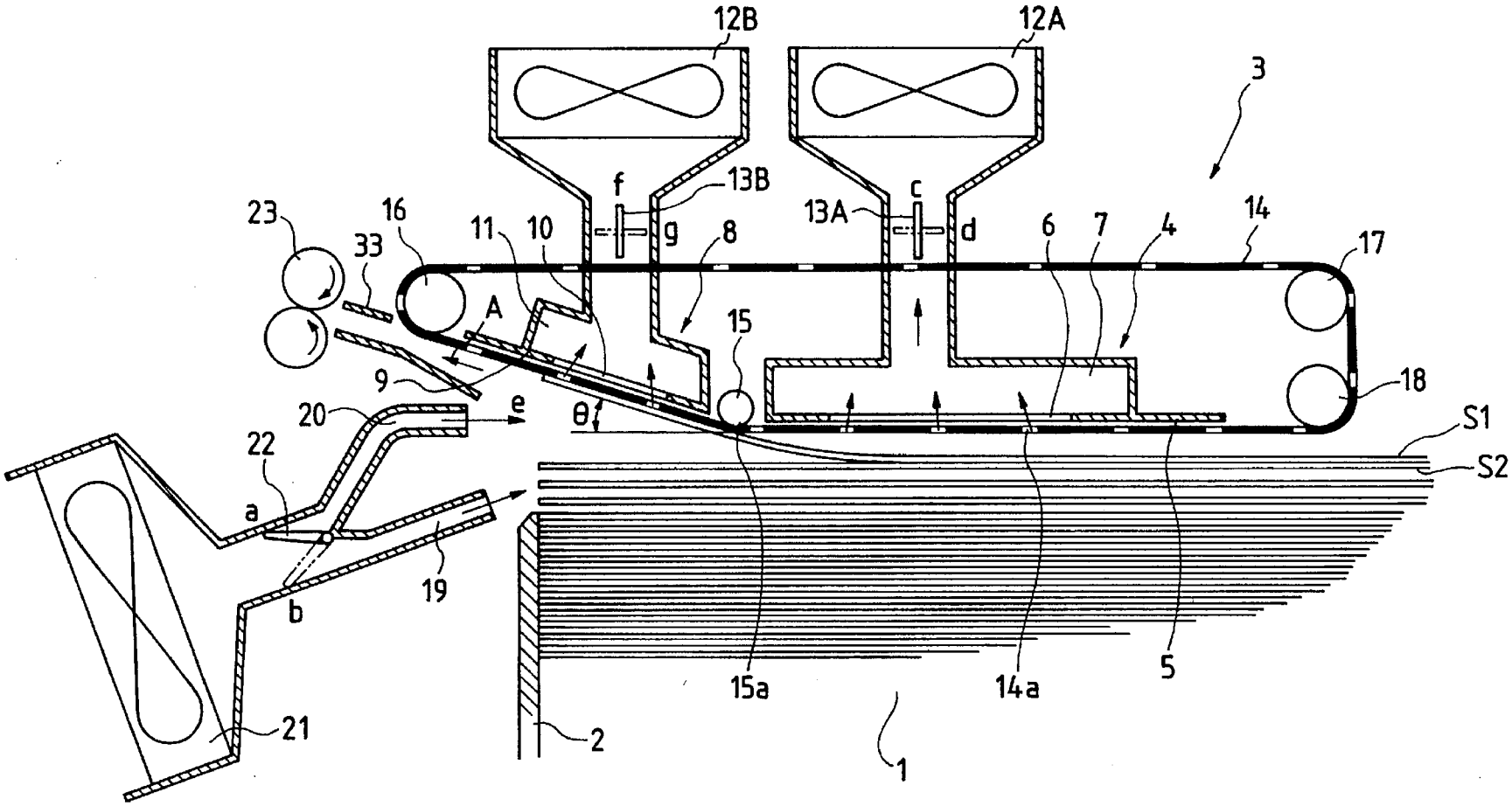
FIG. 23 is a sectional view of a sheet supply apparatus which can improve a sheet separating ability.

Regarding the sheet having small rigidity, the setting operation will be explained with reference to FIG. 22. In this case, since the detection member 30 is subjected to the downwardly directing force by its own weight, when the sheet is absorbed, the rear end portion of the sheet is lowered from the flat bottom surface 5. That is to say, the detection member 30 is brought to the lowered condition, thereby turning the photo-sensor 31 OFF. In case of the sheet having small rigidity, if the angle θ is small, since the second sheet S2 is apt to be absorbed when the first sheet S1 is absorbed, the angle θ must be increased. To do so, the rack 177 is lifted by the motor 179.

In the illustrated embodiment, while the sheet feature detecting means shown in FIG. 1 was used, the sheet feature detecting means regarding other embodiments which were already explained may be used.

Next, similar to the sheet supply apparatus shown in FIG. 1, a sheet supply apparatus wherein the sheets can be separated more positively by controlling the sheet absorbing timing of the sheet absorb portions even when the rigidity of the sheet is great will be explained with reference to FIGS. 23 to 26. Incidentally, since the construction of the sheet supply apparatus itself is the same as that of FIG. 1, explanation thereof will be omitted.

First of all, when the valve 22 is switched to the position a by the switching means such as the solenoid (not shown) and the blower 21 is operated, the air is injected from the nozzle 19 toward the tip end of the sheet stack, thereby floating several sheets from the sheet stack. Then, blowers 12A, 12B are operated. Thereafter, a valve 13B is switched to a position f by a switching means such as a solenoid (not shown), thereby sucking air through the suction opening 10 and the suction holes 14*a*.

Consequently, the uppermost sheet S1 is absorbed to the second sheet absorb portion 8 and is closely contacted with the convey belt 14. In this case, since the second sheet absorb portion 8 alone is operated and the rear end portion of the sheet S1 is not restrained, only the tip end portion of the sheet S1 is surely absorbed to the second sheet absorb portion 8. Accordingly, the sheet S1 alone is apt to be separated and conveyed. Thereafter, a valve 13A is switched to a position c by a switching means such as a solenoid (not shown), thereby sucking air through the suction opening 6 and the suction holes 14*a*. As a result, the sheet is deformed around the displacement fulcrum 15*a* in opposition to the rigidity of the sheet, thereby closely contacting the tip end portion and central portion of the sheet with the convey belt 14.

Figure 24:
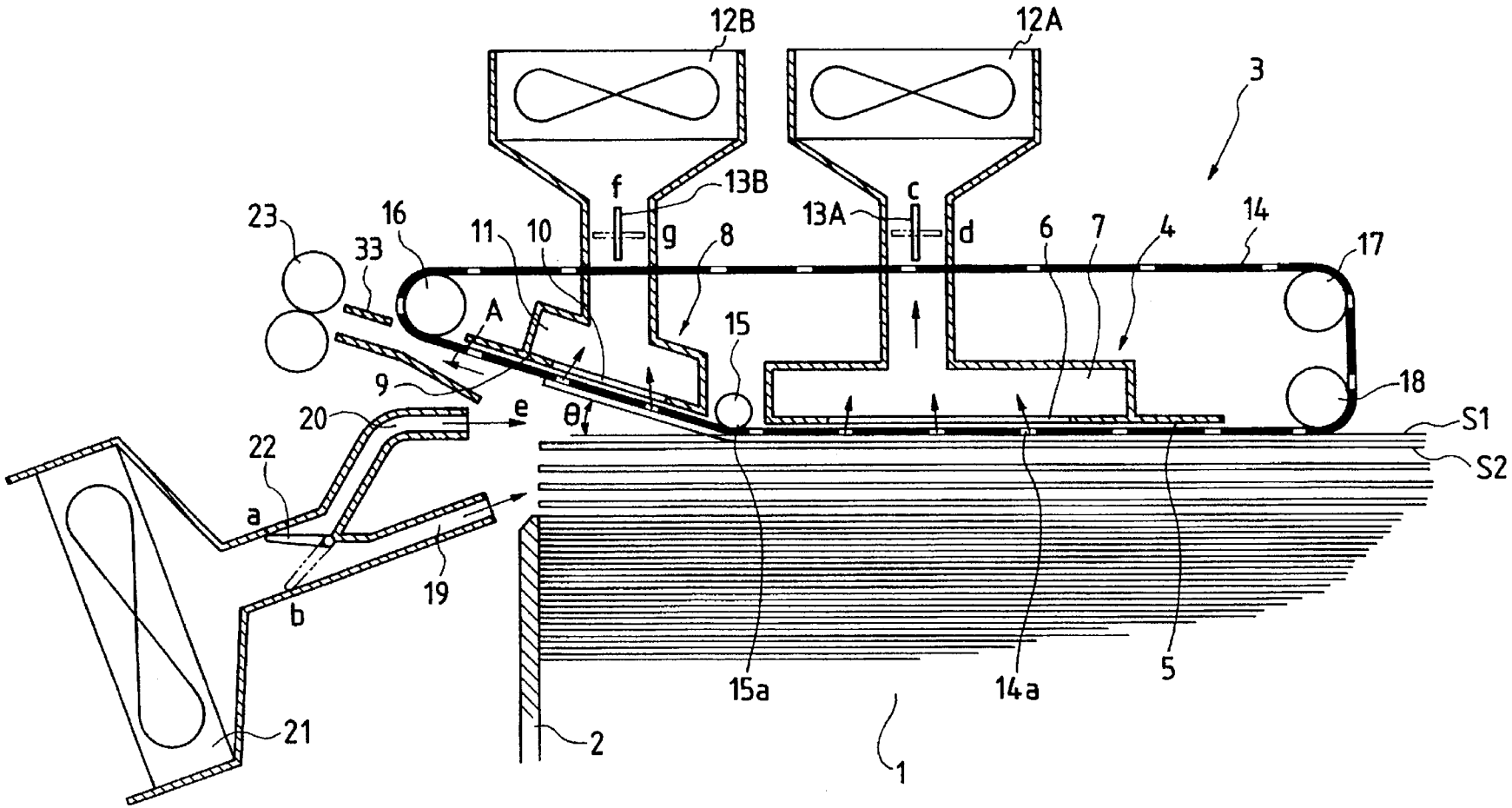
FIG. 24 is a view showing an operation of the sheet supply apparatus of FIG. 23.

More particularly, as shown in FIG. 24, the central portion of the sheet is absorbed to the first sheet absorb portion 4 and the tip end portion of the sheet is absorbed to the second sheet absorb portion 8. That is to say, the sheet S1 follows the substantially flat bottom surfaces 5, 9 and is deformed around the displacement fulcrum 15*a* in a downwardly convex L-shaped configuration. In this case, it is assumed that the second sheet S2 is closely contacted with the first sheet S1. In such a case, the central portion of the sheet S2 substantially follows the sheet S1. However, since the surface of the second sheet absorb portion 8 is covered by the sheet S1, the tip end portion of the sheet S2 is not absorbed.

Accordingly, in accordance with the rigidity of the sheet, the sheet S2 is not deformed around the displacement fulcrum 15*a* to keep the flat condition, with the result that the tip end portion of the sheet S2 is separated from the sheet S1 to create the gap e therebetween (FIG. 24). Thereafter, the convey belt 14 is driven by the drive means to convey the sheet S1 in the direction shown by the arrow A. At the same time, the valve 22 is switched to the position b and the air is injected from the nozzle 20 toward the gap e between the sheets S1, S2, thereby separating the sheet S2 from the sheet S1 stably. Accordingly, the sheet S1 alone is conveyed downstreamly to reach the pair of convey rollers 23. After the predetermined time is elapsed (i.e. after the sheet is pinched between the convey rollers 23), valves 13A, 13B are switched to positions d, g, respectively, and the blowers 12A, 12B are stopped. Further, after the predetermined time is elapsed (i.e. after the sheet leaves the pair of convey rollers 23), the convey belt 14 and the blower 21 are stopped, and the valve 22 is switched to the position a, thereby finishing the sheet supplying operation.

Figure 25:
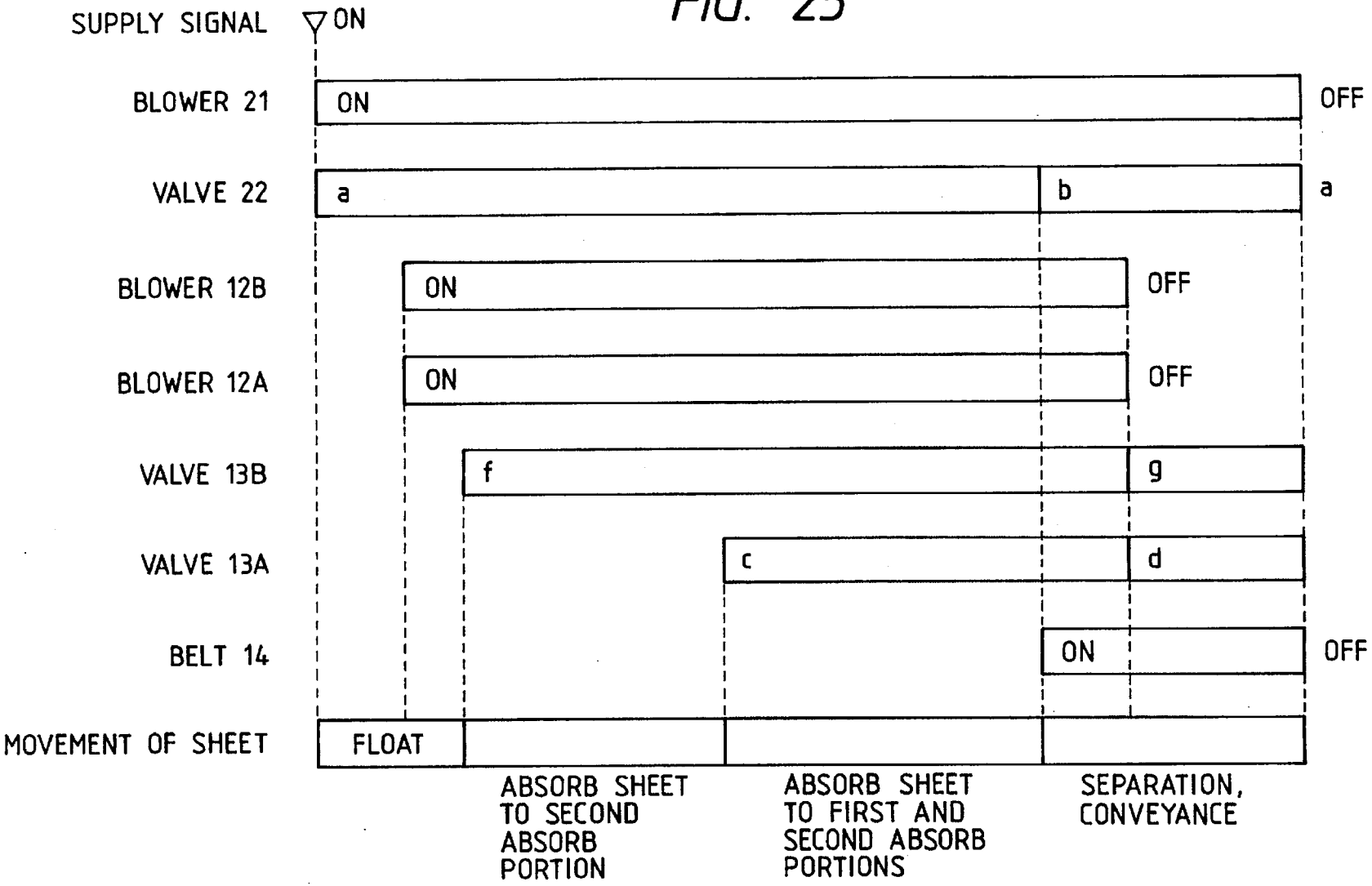
FIG. 25 is a timing chart of the sheet supply apparatus of FIG. 23.
Figure 26:
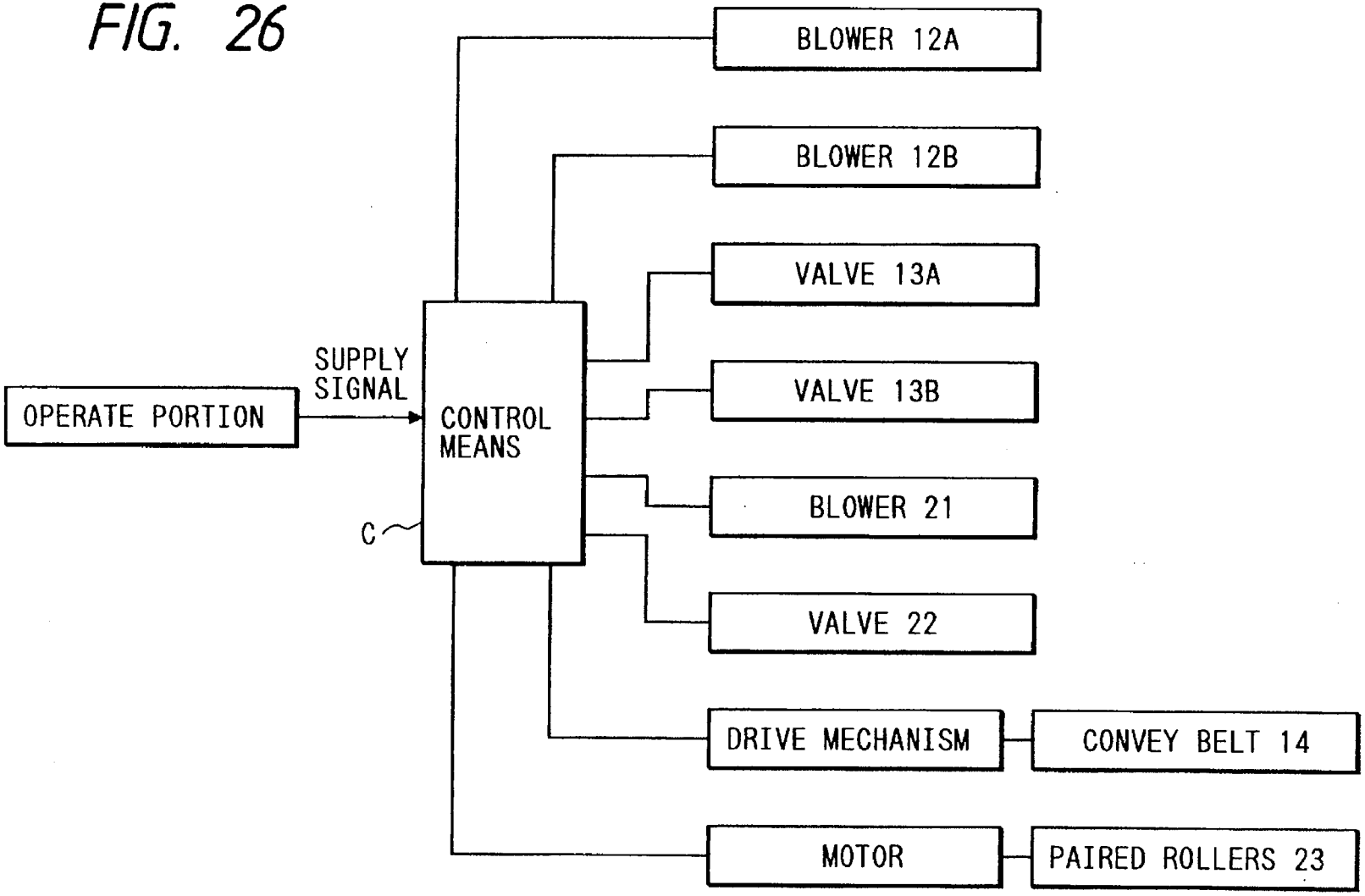
FIG. 26 is a control block diagram of the sheet supply apparatus of FIG. 23.
Figure 27:
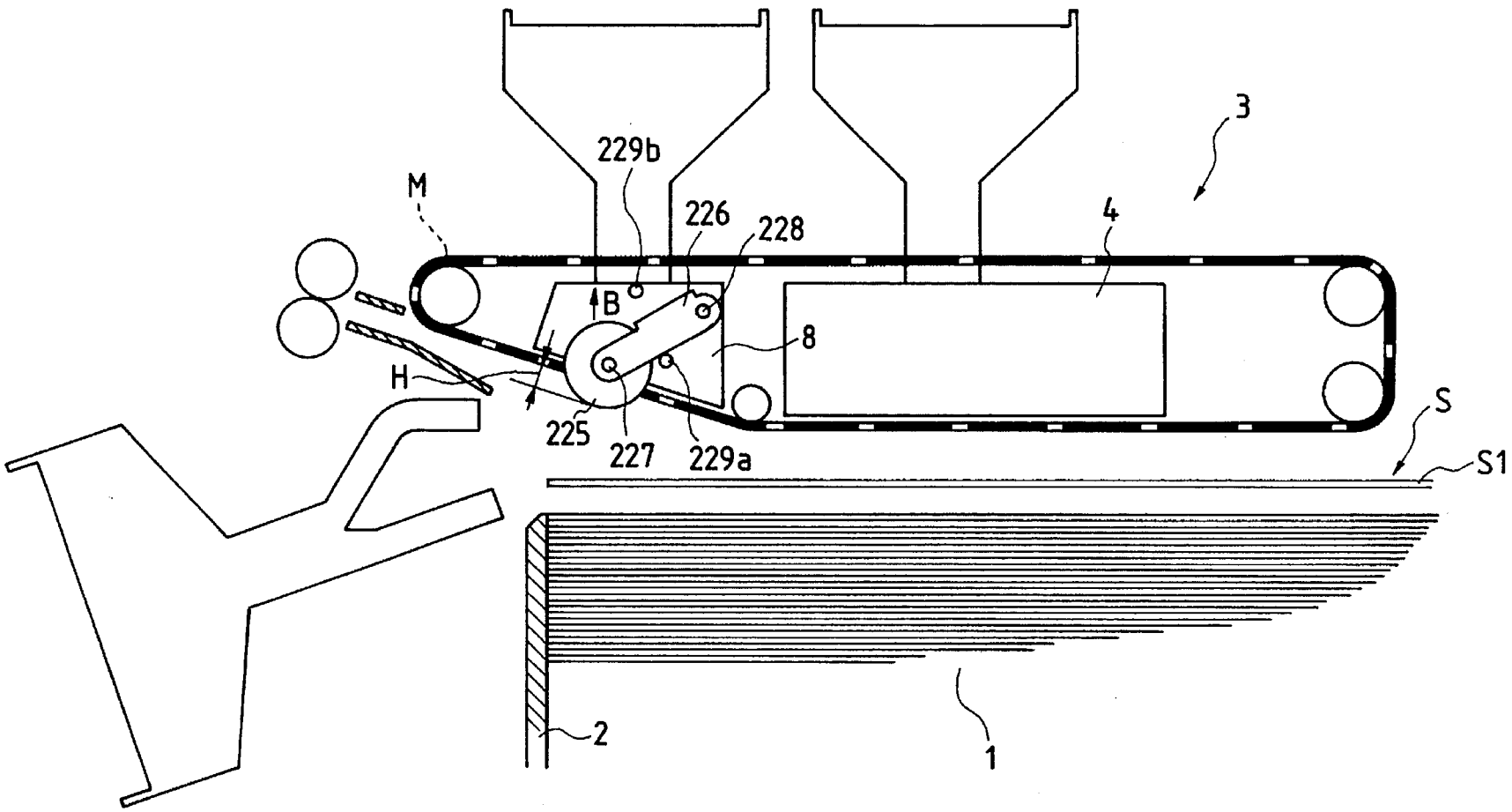
FIG. 27 is a side view of a sheet supply apparatus which can improve a sheet separating ability, according to another embodiment.
Figure 28:
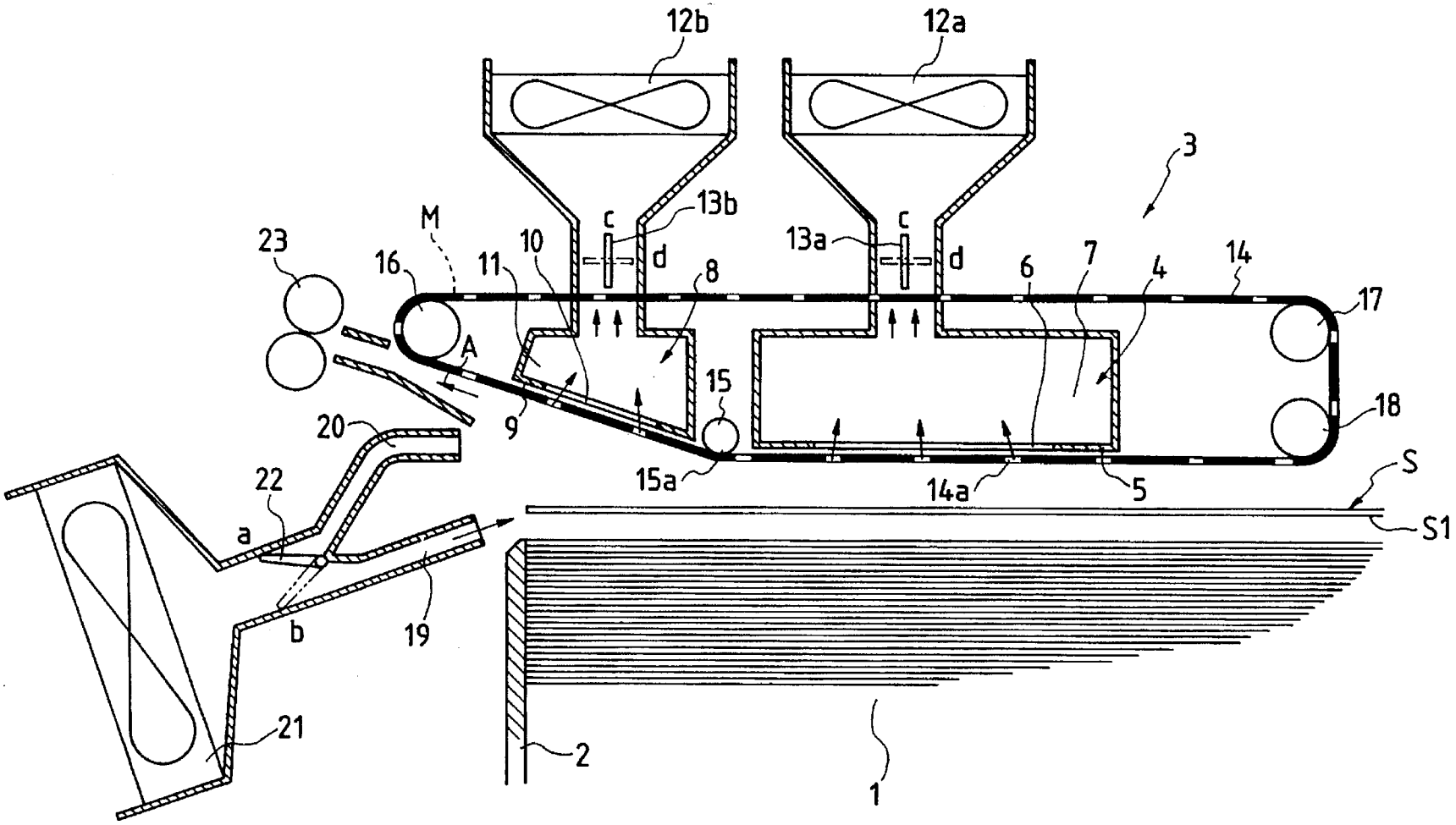
FIG. 28 is a sectional view of the sheet supply apparatus of FIG. 27.

FIG. 25 is a timing chart for effecting the above operations and FIG. 26 is a block diagram for effecting the above operations.

In this way, when the tip end portion of the sheet is firstly absorbed, even if the sheet has great thickness and great resiliency, the sheet can surely be absorbed to the first end second sheet absorb portions, thereby positively separating the sheets.

Next, another example that the sheet is positively separated will be explained with reference to FIGS. 27 to 33B. Incidentally, since the fundamental construction of the sheet supply apparatus itself is the same as that of FIG. 1, explanation thereof will be omitted.

Figure 29:
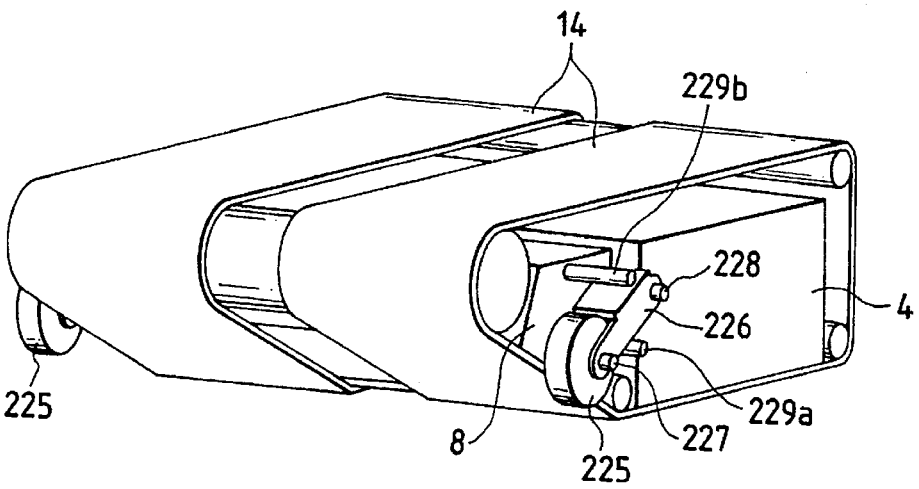
FIG. 29 is a perspective view of a main portion of the sheet supply apparatus of FIG. 27.

As shown in FIG. 29, a protruded roller 225 for deforming the sheet in a direction substantially perpendicular to the deforming direction of the sheet effected by the displacement fulcrum 15*a* is arranged at one side of the convey belt 14 and is supported by a support arm 226. The protruded roller 225 is rotatably mounted on a support shaft 227 attached to the support arm 226. The support arm 226 is pivotally mounted on a pin 228, and stoppers 229*a*, 229*b* limit a rocking range of the support arm. The pin 228 is arranged at an upstream side of the support shaft 227 in the sheet conveying direction.

The protruded roller 225 is urged by a pressurizing means (not shown) to protrude from the sheet absorb surface, so that, when the sheet S is not absorbed to the second sheet absorb portion 8, the roller is abutted against the stopper 229*a*, and, when the sheet is absorbed to the second sheet absorb portion, the roller is rocked by the sheet S to change a protruded height H which will be described later.

Next, the operation of such air sheet supply apparatus will be explained.

First of all, when the valve 22 is switched to the position a by the switching means such as the solenoid (not shown) and the blower 21 is operated, the air is injected from the nozzle 19 toward the tip end of the sheet stack, thereby floating several sheets. Then, the valves 13*a*, 13*b* are switched to the position c by the switching means such as the solenoid and the blowers 12*a*, 12*b* are operated, thereby sucking the air through the suction openings 6, 10 and the suction holes 14*a*. As a result, the uppermost sheet S1 is absorbed to the first and second sheet absorb portions 4, 8 and is closely contacted with the convey belt 14. More particularly, the central portion of the sheet is absorbed to the first sheet absorb portion 4 and the tip end portion of the sheet is absorbed to the second sheet absorb portion 8, and the sheet is deformed by the protruded roller 225 in the direction substantially perpendicular to the deforming direction of the sheet effected by the displacement fulcrum 15*a*. That is to say, the sheet S1 is deformed in two directions.

Figure 30A:
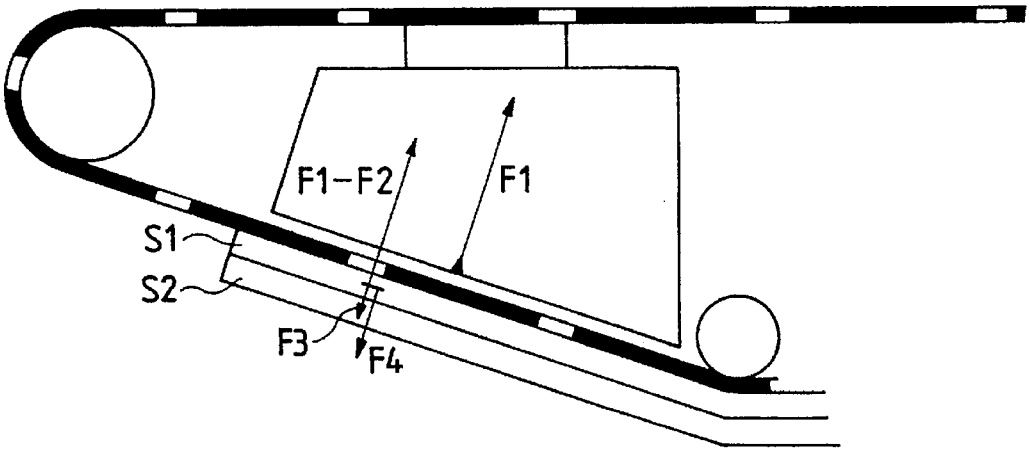
FIGS. 30A and 30B are views showing a relation between forces generated in air absorption in the sheet supply apparatus of FIG. 27.
Figure 30B:
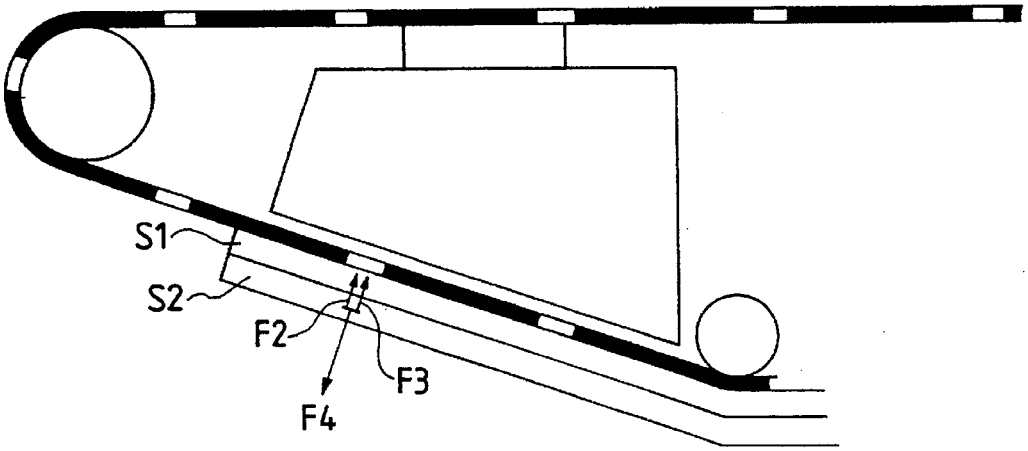

With this arrangement, the double-feed of sheets can be prevented as follows. FIG. 30A is a schematic view showing forces acting on the first sheet S1, and FIG. 30B is a schematic view showing forces acting on the second sheet S2. In these Figures, for simplicity's sake, although the sheet is deformed in one direction, the forces for deforming the sheet in two directions will be explained.

First of all, before the absorption, it is assumed that the second sheet S2 is closely contacted with the first sheet S1. In this case, in FIGS. 30A and 30B, symbols are defined as follows. F1 is a force given from the first and second sheet absorb portions, and F2 is a component of the force F1 passing through fiber tissue of the first sheet S1 and acting on the second sheet S2. F3 is a force for adhering the sheets S1, S2 to each other due to the interaction between the fiber tissues of the sheets S1, S2 when the first sheet S1 tries to be deformed. In the absorbing operation, although the sheet is deformed in two directions as mentioned above, when the sheet is deformed unnaturally in this way, the great force must apply to the sheet. This force is defined as F4.

The absorbing force (F1–F2) from the absorb portions acts on the first sheet S1, and the force F3 opposed to the absorbing force also acts on the first sheet. Since the force F1 is set to satisfy a relation ((F1–F2–F3)>F4), the sheet S1 is absorbed while being deformed in two direction.

Figure 31:
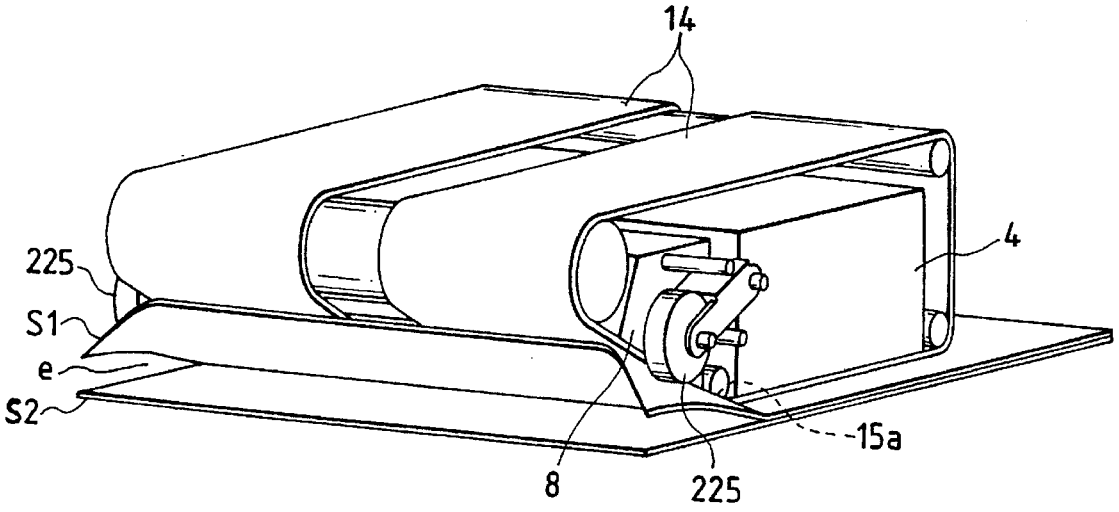
FIG. 31 is a view showing a sheet separating operation in the main portion shown in FIG. 29.

The forces F2, F3 act on the second sheet S2 in the absorbing direction. Since the protruded height H (described later) of the protruded roller 225 is changed so that the sum of these forces (F2+F3) becomes smaller than the force F4 required for deforming the sheet in two direction (i.e. (F2+F3)<F4), as shown in FIG. 31, only the first sheet S1 is deformed in two directions, and the second sheet S2 is not deformed in two directions to keep the flat condition. As a result, a gap e is created between the sheets S1, S2. Then, the valve 22 is switched to the position b to inject the air from the nozzle 20 toward the gap e, thereby positively separating the second sheet S2 from the first sheet S1.

In this way, the double-feed of the sheets is prevented, and the sheet S1 alone is conveyed downstreamly. In this case, since the protruded roller 225 is rocked, the roller does not apply any load in the sheet convey direction. Further, when the sheet starts to be conveyed, since the protruded roller 225 is retarded upwardly (direction B in FIG. 27), the resistance of the roller is further reduced, thereby stabilizing the sheet absorption. Accordingly, it is possible to stably supply the sheet.

In the illustrated embodiment, the height of the protruded roller 225 can be changed to stably supply various kinds of sheets. Now, the function will be explained.

Figure 32A:
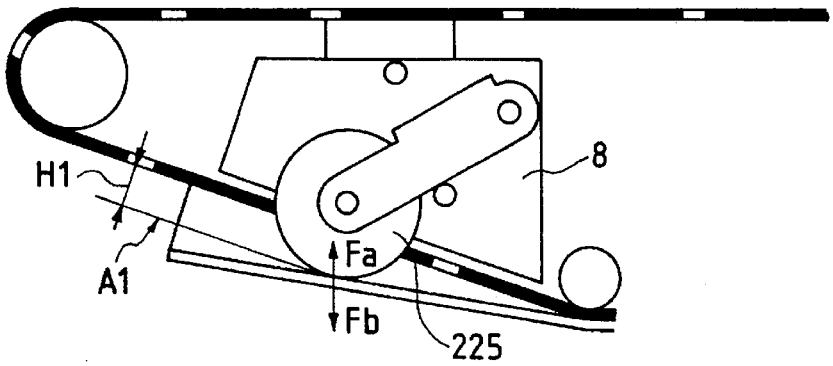
FIGS. 32A and 32B are views showing a condition that a sheet having small rigidity is separated in the main portion shown in FIG. 29.
Figure 32B:
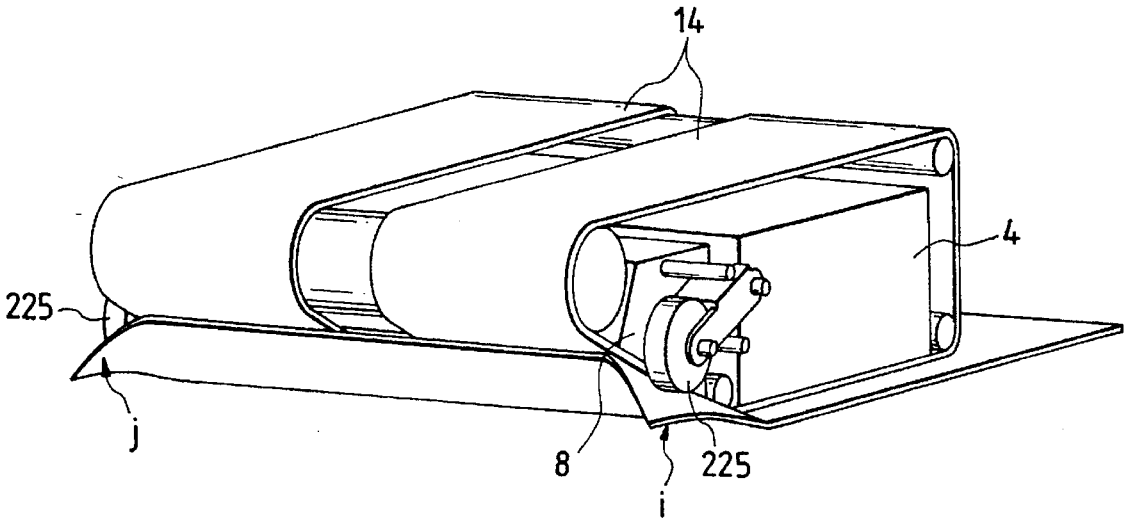
Figure 33A:
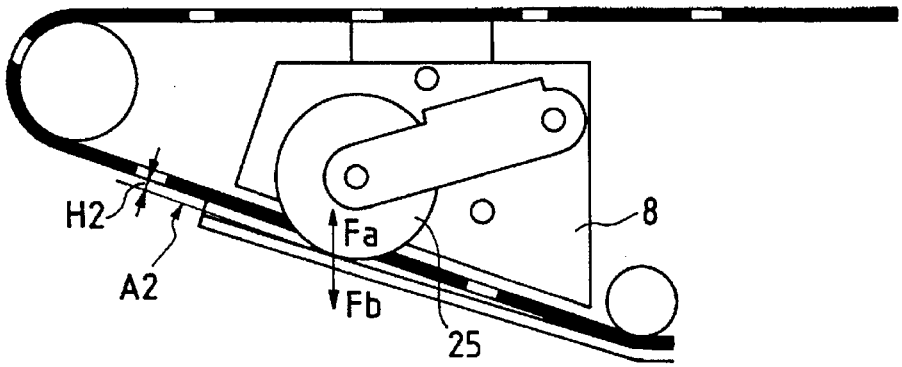
FIGS. 33A and 33B are views showing a condition that a sheet having great rigidity is separated in the main portion shown in FIG. 29.
Figure 33B:
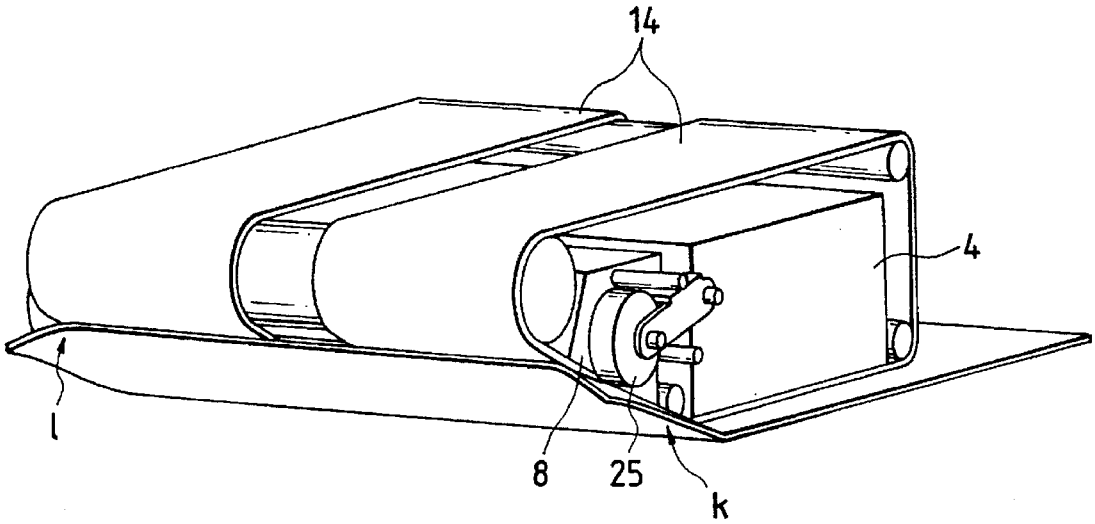

FIGS. 32A and 32B are explanatory views for explaining the operation of the protruded roller 225 regarding the sheet having small rigidity, and FIGS. 33A, 33B are explanatory views for explaining the operation of the protruded roller 225 regarding the sheet having great rigidity.

When the sheet is absorbed to the first and second sheet absorb portions 4, 8, in the proximity of the sheet, sheet portions (i, j , k, l) which are not absorbed to the second sheet absorb portion 8 are subjected to an upwardly directing force (Fa) to follow the surface of the second sheet absorb portion 8. However, since the sheet portions are pushed downwardly by the lowering force (Fb) of the protruded roller 225, the sheet and the roller are stopped at a position where these two forces are balanced.

Thus, in case of the sheet having small rigidity, since the force for urging the protruded roller 225 is small, the protruded roller 225 is stopped at a position A1 (having protruded height H1) in FIG. 32A where the roller is protruded greatly. In this way, when the rigidity of the sheet is changed in accordance with the kind of sheet, the position where the above two forces are balanced is also changed. In this way, the protruded height of the protruded roller 225 is changed.

By the way, the protruded height of the protruded roller 225 and the rigidity of the sheet must be as follows in order to supply the sheet stably. In case of the sheet having great rigidity, even when the protruded height H is relatively small (i.e. even when the sheet is not greatly deformed in two directions), the above-mentioned force P4 satisfy the relation for preventing the double-feed ((F2+F3)<F4). If the protruded height H is excessively increased (i.e. if the sheet is deformed greatly), the force F4 is increased so that the relation ((F1−F2−F3)>F4) is not satisfied, thereby causing the poor absorption of the first sheet S1 to the sheet absorb portions.

In case of the sheet having small rigidity, so long as the protruded height H is relatively small (i.e. so long as the sheet is deformed slightly in two direction), the force F4 does not satisfy the relation for preventing the double-feed ((F2+F3)<F4).

Thus, by adjusting the upward force Fa for urging the sheet against the surface of the second sheet absorb portion 8 and the downward force Fb for lowering the protruded roller 225 to set the positions A1, A2 to optimum positions for the sheet having great rigidity and the sheet having small rigidity, respectively, it is possible to stably supply various kinds of sheets.

Incidentally, the force for protruding the protruded roller 225 from the sheet absorb surface may be created by an elastic body such as a spring, as well as the weight of the roller itself. Further, any means capable of changing the protruded height H of the protruded roller 225 to satisfy the above relation may be adopted. Further, in place of the protruded roller, a rotatable ball member or a semi-cylindrical protruded member having small coefficient of friction may be used.

Next, a further embodiment for positively separating the sheets will be explained with reference to FIGS. 34 and 35. Incidentally, the same elements as those shown in FIG. 1 are designated by the same reference numerals and explanation thereof will be omitted.

In this case, the total area B1 of the suction holes 14*a* of the convey belt 14 overlapped with the suction opening 6 of the first sheet absorb portion 4 is smaller than the total area B2 of the suction holes 14*a* of the convey belt 14 overlapped with the suction opening 10 of the second sheet absorb portion 8. (This condition can be represented by the following relations: that is to say, B1=J×A1×T, B2=J×A2×T, B2>B1. Where, J is a width of the suction openings 6, 10 (although not shown, the width of the opening 6 is the same as the width of the opening 10), A1, A2 are length of the suction openings 6, 10, and T is a percentage of the area of the suction holes 14*a* regarding the area of the convey belt 14.) Further, since both the first and second sheet absorb portions 4, 8 are air-sucked by the same blower 12 and the pressure in the duct (suction chamber 7) is substantially the same as the pressure in the suction chamber 11, the absorbing force of the second sheet absorb portion 8 is greater than the absorbing force of the first sheet absorb portion 4. Further, the roller 15 is arranged at a junction between the first flat bottom surface 5 and the second flat bottom surface 9 and acts as a displacement fulcrum 15*a* for deforming the sheet in a downwardly convex shape.

There are provided a nozzle 19 for injecting air to float several sheets, and a nozzle 20 for injecting air to separate a single sheet from the other sheets. The nozzles 19, 20 are connected to an air injection blower 21. Air injections from the nozzles 19, 20 are selectively switched by a valve 22. A pair of convey rollers 23 are provided for further conveying the sheet downstreamly.

Next, the operation of the above-mentioned sheet supply apparatus will be explained.

When the valve 22 is switched to a position a by a switching means such as a solenoid and the like (not shown) and the blower 21 is operated, the air is injected from the nozzle 19 toward a tip end of the sheet stack. As a result, several sheets are floated. Then, when the valve 13 is switched to a position c by a switching means such as a solenoid and the like and the blower 12 is operated, the air is sucked through the suction openings 6, 10 and the suction holes 14*a*. Consequently, the uppermost sheet S1 is absorbed to the first and second sheet absorb portions 4, 8 to be closely contacted with the convey belt 14.

Figure 34:
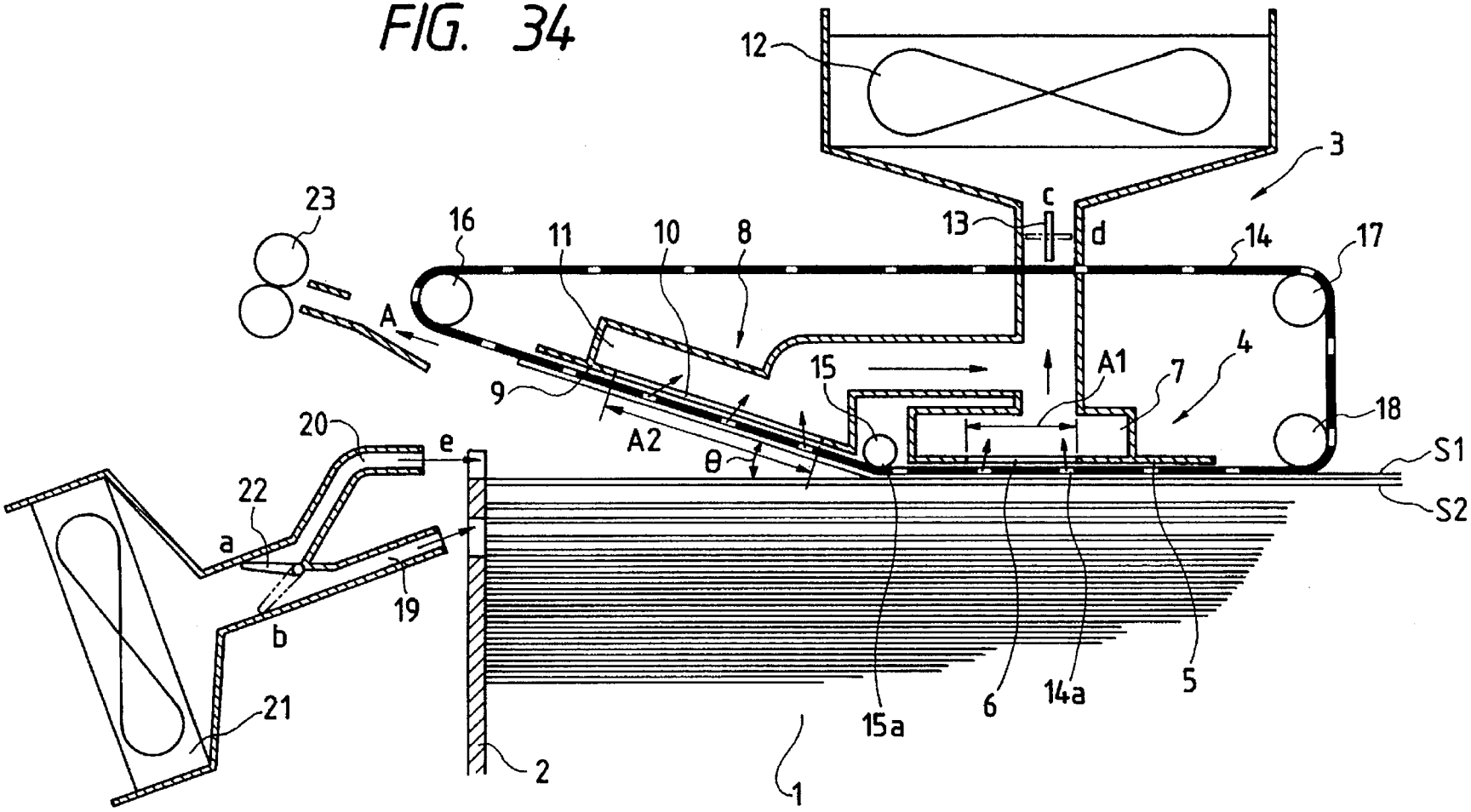
FIG. 34 is a sectional of a sheet supply apparatus which can improve a sheet separating ability, according to a further embodiment.

More specifically, as shown in FIG. 34, a central portion of the sheet S1 is absorbed to the first sheet absorb means 4 and a tip end portion of the sheet is absorbed to the second absorb portion 8. In this case, the sheet S1 is deformed around the displacement fulcrum 15*a* in opposition to the rigidity (elastic force) of the sheet S1 under the action of the absorbing force of the first and second sheet absorb portions, so that the tip end portion and the central portion of the sheet S1 are both closely contacted with the convey belt 14. That is to say, the sheet S1 follows the substantially flat bottom surfaces 5, 9 to be deformed around the displacement fulcrum 15*a* in a downwardly convex L-shaped configuration. In this case, it is assumed that the second sheet S2 is closely contacted with the first sheet S1. In such a case, the central portion of the second sheet S2 substantially follows the first sheet S1.

However, since the surface of the second sheet absorb portion 8 is covered by the sheet S1, the tip end of the sheet S2 is not subjected to the absorbing force of the second sheet absorb portion 8. Accordingly, the second sheet S2 is not deformed around the displacement fulcrum 15*a* to keep a flat condition. As a result, a tip end of the second sheet is separated from a tip end of the first sheet to create a gap e therebetween.

Thereafter, the convey belt 14 is driven by the drive means (not shown) to convey the sheet S1 in the direction shown by the arrow A. At the same time, the valve 22 is switched to a position b, so that the air is injected from the nozzle 20 toward the gap e between the sheets S1, S2, thereby separating the sheet S2 from the sheet S1 stably. After the sheet S2 is separated from the sheet S1, if the sheet S2 is partially contacted with the sheet S1 for some reason to cause the double-feed of the sheets, since the sheet S2 is stopped by the sheet align guide plate 2, the sheet S1 alone is conveyed downstreamly to reach the pair of convey rollers 23.

Figure 35:
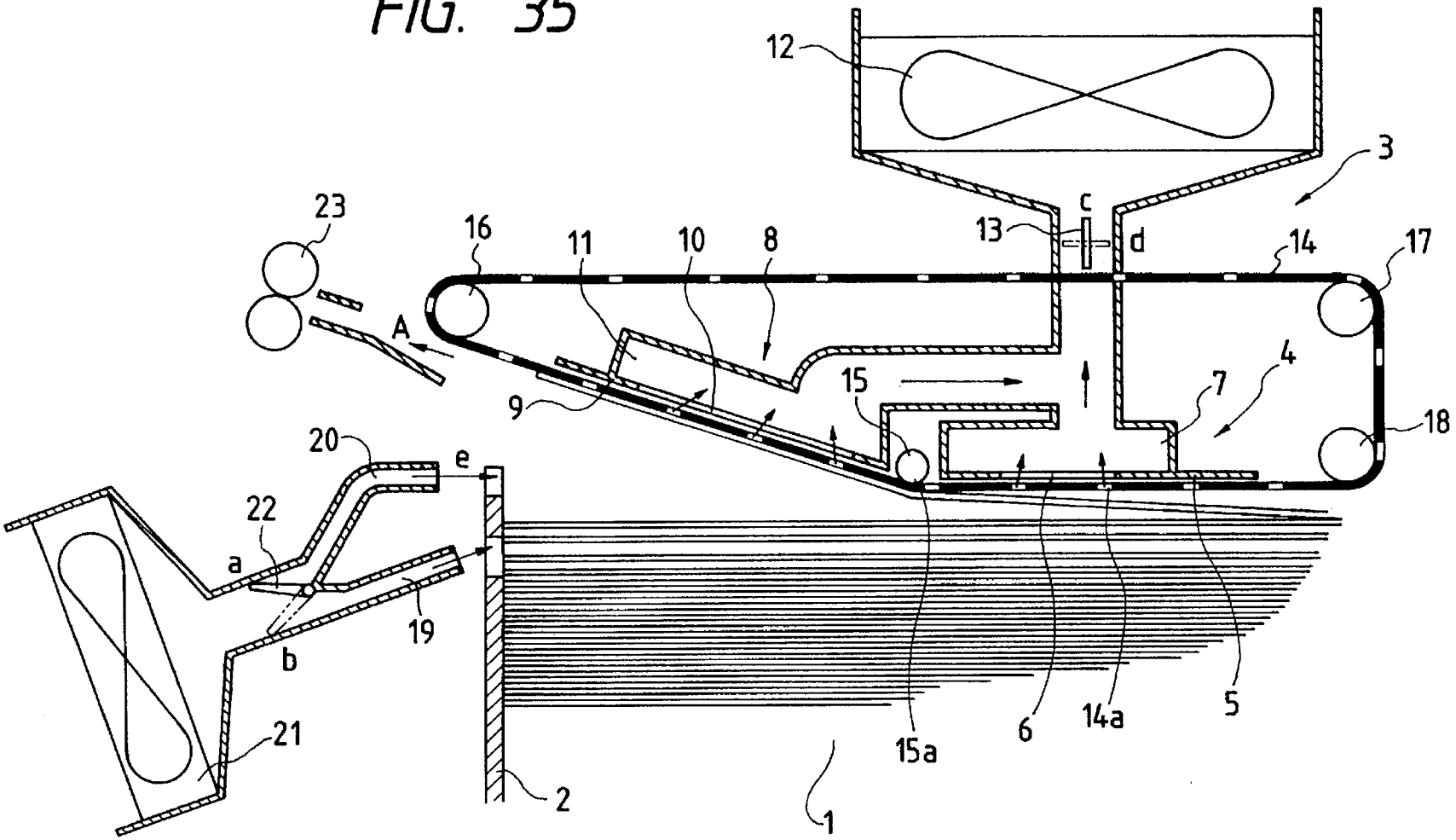
FIG. 35 is a view similar to FIG. 34, showing a sheet supplying condition.

FIG. 35 shows the operation of the sheet supply apparatus for supplying the sheet having great rigidity.

In this case, in the sheet supply apparatus, the sheet S1 cannot often be absorbed to the first and second sheet absorb portions 4, 8 simultaneously. In such a case, since the absorbing force of the second sheet absorb portion 8 is greater than the absorbing force of the first sheet absorb portion 4, the sheet S1 is completely absorbed to the second sheet absorb portion 8 alone, and, although the sheet S1 approaches the first sheet absorb portion 4 more or less, it cannot be completely absorbed to the first sheet absorb portion 4.

The force for conveying the absorbed sheet S1 is obtained from the absorbing force of the second sheet absorb portion 8, and, since the sheet S1 is completely absorbed to the second sheet absorb portion 8, the tip end of the sheet S1 (downstream end in the sheet conveying direction) rides over the sheet align guide plate 2 to reach the pair of convey rollers 23. Since the sheet S1 is deformed around the displacement fulcrum 15*a* in a downwardly convex L-shaped configuration more or less, even if the second sheet S2 is closely contacted with the first sheet S1, the second sheet S2 is separated from the first sheet S1 in the same manner as FIG. 34.

Next, a still further embodiment will be explained with reference to FIGS. 36 and 37.

Figure 36:
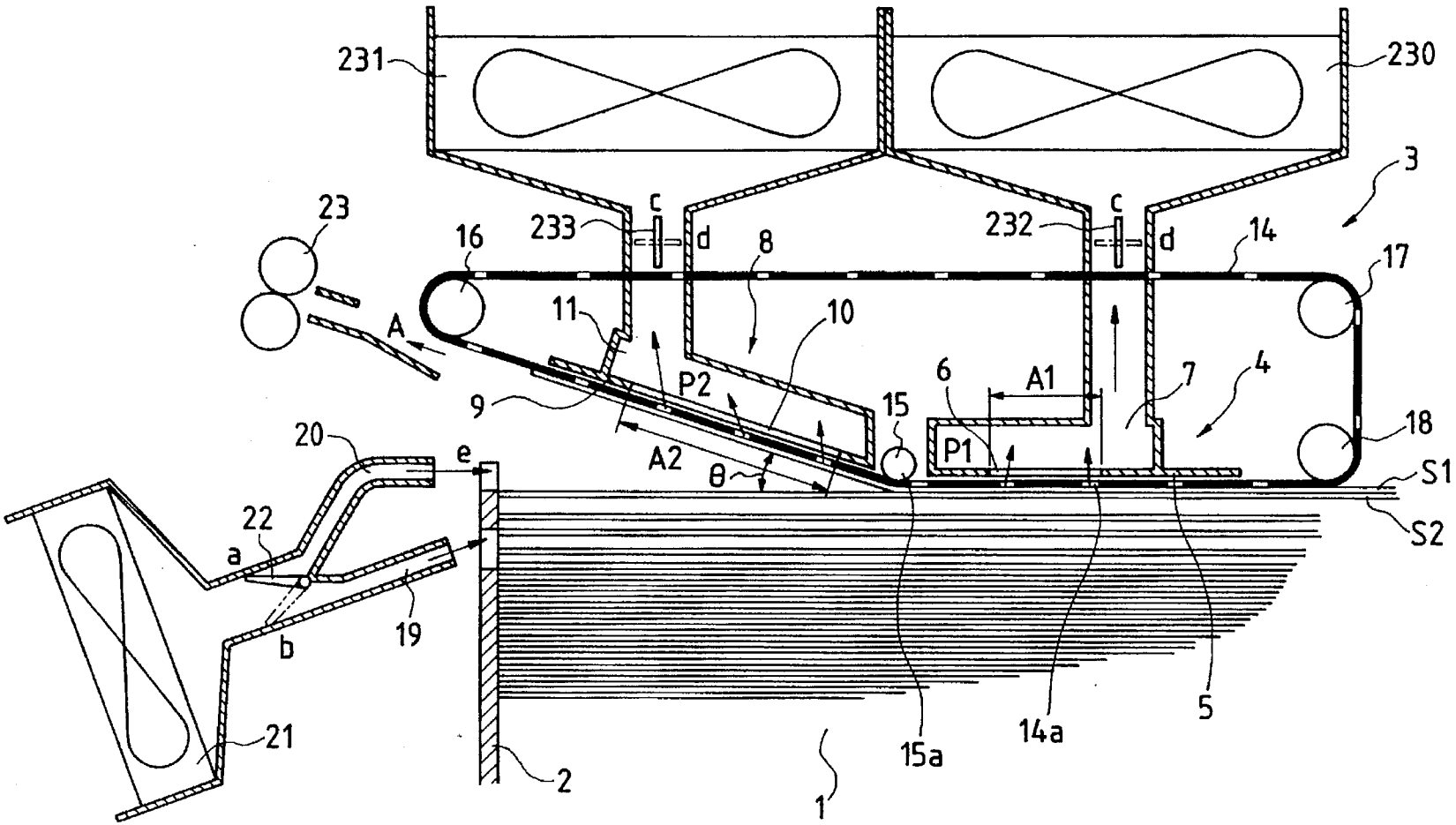
FIG. 36 is a sectional of a sheet supply apparatus which can improve a sheet separating ability, according to a still further embodiment.

In FIG. 36, a first suction blower 230 for sucking air is connected to the first sheet absorb portion 4, and a second suction blower 231 for sucking air is connected to the second sheet absorb portion 8.

In this embodiment, when pressure in the suction chamber 7 reduced by the first suction blower 230 is P1, pressure in the suction chamber 11 reduced by the second suction blower 231 is P2, total area of the suction holes 14*a* of the convey belt 14 overlapped with the suction opening 6 of the first sheet absorb portion 4 is B1 and total area of the suction holes 14*a* of the convey belt 14 overlapped with the suction opening 10 of the second sheet absorb portion 8 is B2, the following relation is satisfied:

$$(P1 \times B1) < (P2 \times B2)$$

A first valve 232 serves to control ON/OFF of the first suction blower 230, and a second valve 233 serves to control ON/OFF of the second suction blower 231.

The blower 12 regarding the aforementioned embodiments and the first and second suction blowers 230, 231 according to this embodiment are operated at the same timing. Further, the blower 12 regarding the aforementioned embodiments and the first and second suction blowers 230, 231 according to this embodiment are stopped at the same timing.

With this arrangement, in the sheet supply apparatus according to this embodiment, the sheets other than the sheet having great rigidity are supplied in the same manner as mentioned above (FIG. 36).

Figure 37:
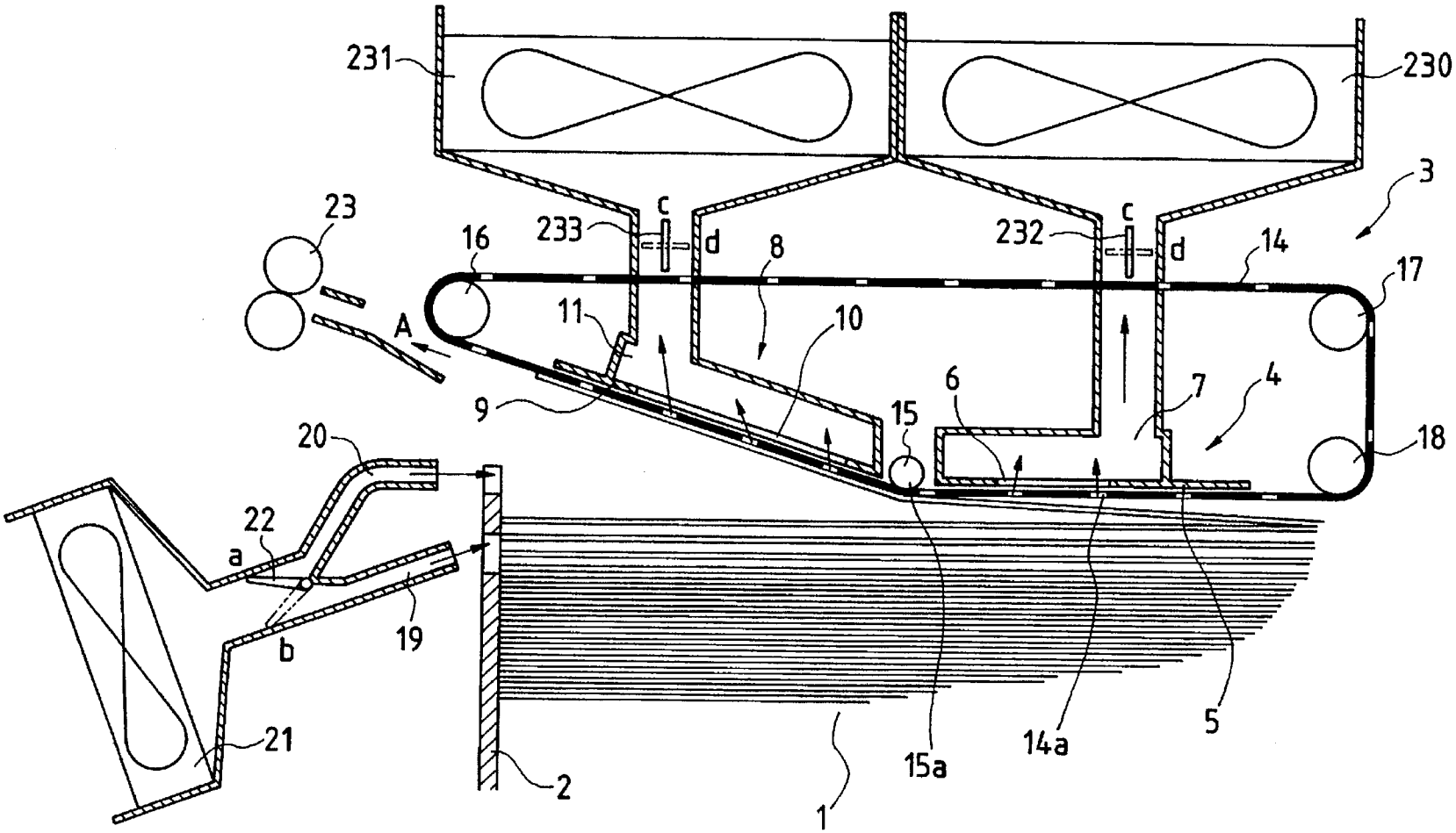
FIG. 37 is a view similar to FIG. 36, showing a sheet supplying condition.

On the other hand, in the sheet supply apparatus according to this embodiment, when the sheet having great rigidity is supplied, as shown in FIG. 37, as is in the aforementioned embodiment, since the absorbing force of the second sheet absorb portion 8 is greater than the absorbing force of the first sheet absorb portion 4 and the sheet S1 is completely absorbed to the second sheet absorb portion 8, the tip end of the sheet S1 (downstream end in the sheet conveying direction) rides over the sheet align guide plate 2 to reach the pair of convey rollers 23.

Since the sheet S1 is deformed around the displacement fulcrum 15*a* in a downwardly convex L-shaped configuration more or less, even if the second sheet S2 is closely contacted with the first sheet S1, the second sheet S2 is separated from the first sheet S1 in the same manner as FIG. 36.

Incidentally, by setting the total area B1 of the suction holes 14*a* regarding the first sheet absorb portion 4 to be the same as the total area B2 of the suction holes 14*a* regarding the second sheet absorb portion 8 and by setting the suction force of the second suction blower 231 to be greater than the suction force of the first suction blower 230, the same effect can be achieved.

Next, an arrangement in which sheets stacked on the sheet tray 1 are positively floated by air will be explained with reference to FIGS. 38 to 41. Incidentally, since the fundamental construction of the sheet supply apparatus itself is the same as that of FIG. 1, explanation thereof will be omitted.

A tip end regulating plate 2 serves to regulate tip ends of sheets S stacked on the sheet tray 1. An upper end of the tip end regulating plate 2 is positioned above a belt surface F of the convey belt 14 covering the first sheet absorb portion 4. Further, an opening 2A for directing air injected from an air injection nozzle 19 to an upper portion of the sheet tray 1 (toward interior of the tip end regulating plate 2) and a notch 2B for directing air injected from an air injection nozzle 20 to an upper portion of the sheet tray 1 (toward interior of the tip end regulating plate 2) are formed in an upper portion of the tip end regulating plate 2.

Further, an auxiliary regulating surface 330 acting as a sheet escaping portion for deflecting a tip end of the uppermost sheet S from the sheet conveying direction is provided at the upper portion of the tip end regulating plate 2. The auxiliary regulating surface 330 is formed by reducing a thickness of the upper portion in comparison with the other portion of the auxiliary regulating surface 330. In this embodiment, an inclined surface 330A also contributes to the sheet escaping action. That is to say, the inclined surface 330A is also included in the sheet escaping portion.

When the sheets S are stacked on the sheet tray 1, the motor 29 is driven in the clockwise direction, thereby lowering the sheet tray 1 to a predetermined position. In this position, the sheets S are stacked on the sheet tray 1. In this case, a sheet stacking amount is regulated by a regulating means (not shown) so that the uppermost sheet S1 does not enter into an area of the auxiliary regulating surface 330.

After the sheet are stacked on the sheet tray 1, the motor 29 is driven in an anti-clockwise direction to lift the sheet tray 1 to a predetermined position. In this case, when the control means 37 receives a detection signal from a sheet detection sensor (sheet position detecting means) 335 for detecting the position of the uppermost sheet S1 in the area of the auxiliary regulating surface 330, the control means stops the motor 29. The control operation is repeated whenever the sheet is supplied.

Figure 38:
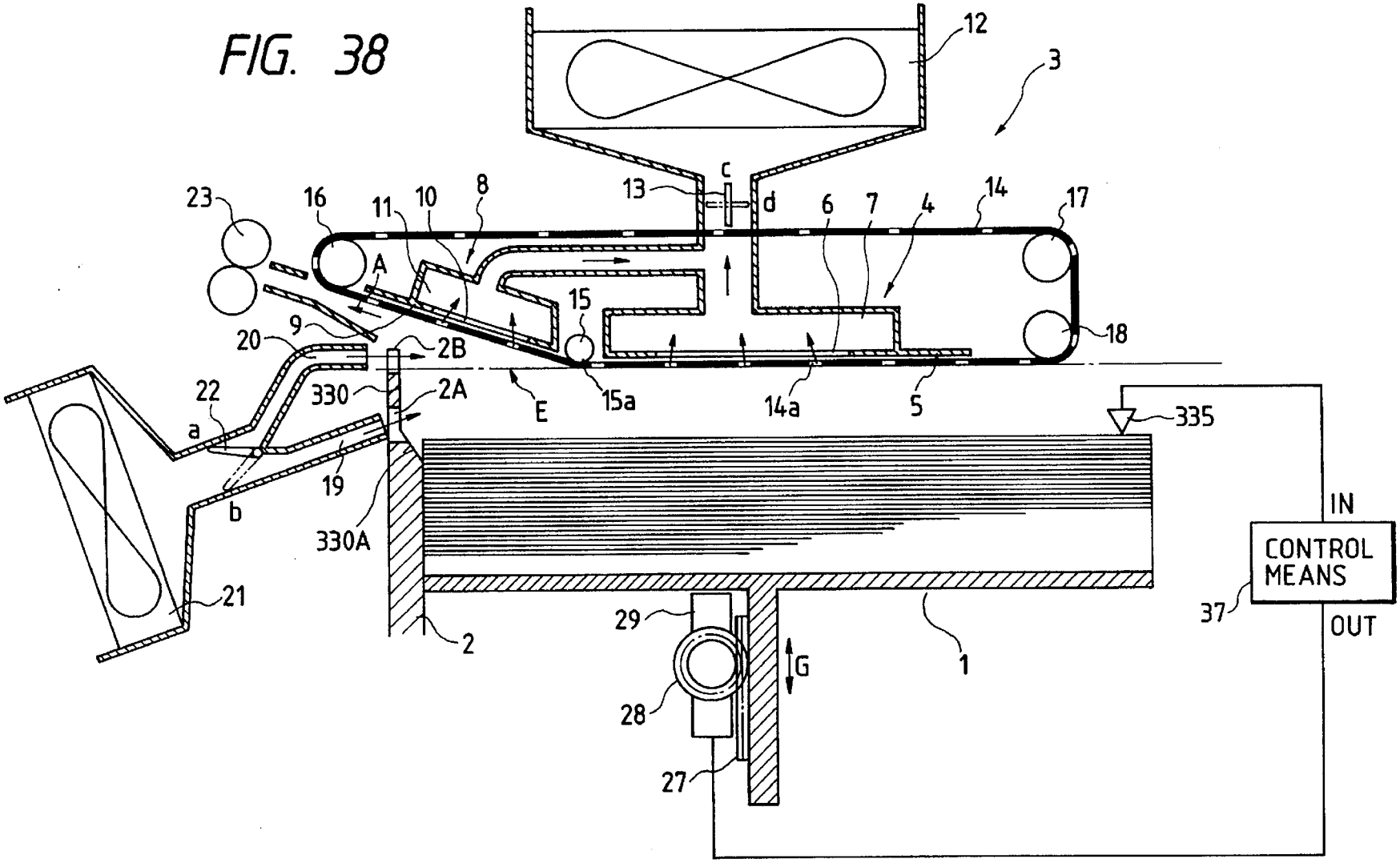
FIG. 38 is a sectional view of a sheet supply apparatus having a mechanism for improving ascent/descent of a sheet stack.
Figure 39:
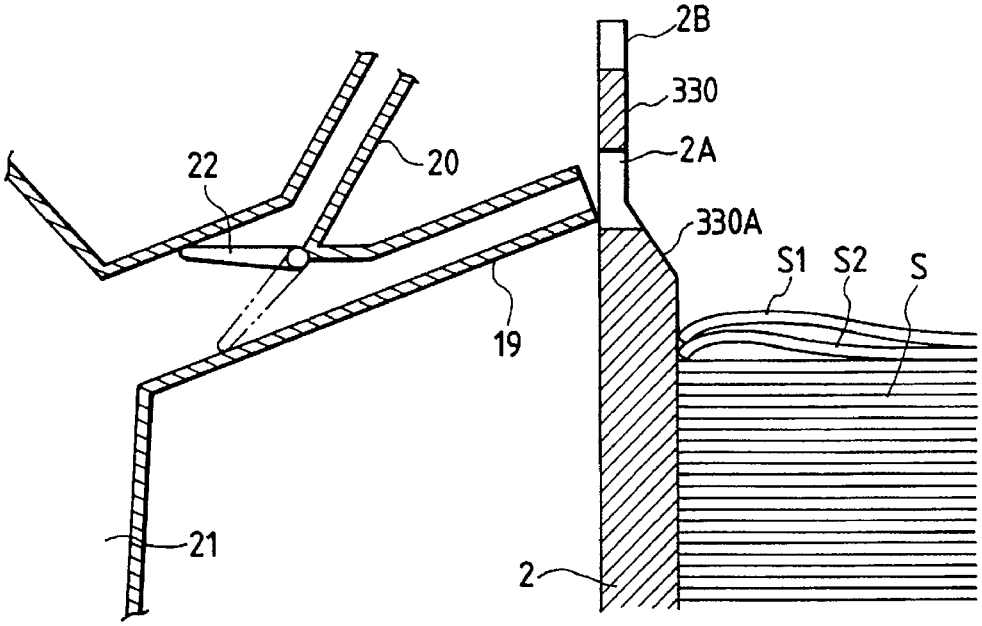
FIG. 39 is an enlarged view of a portion of the sheet supply apparatus of FIG. 38.
Figure 40:
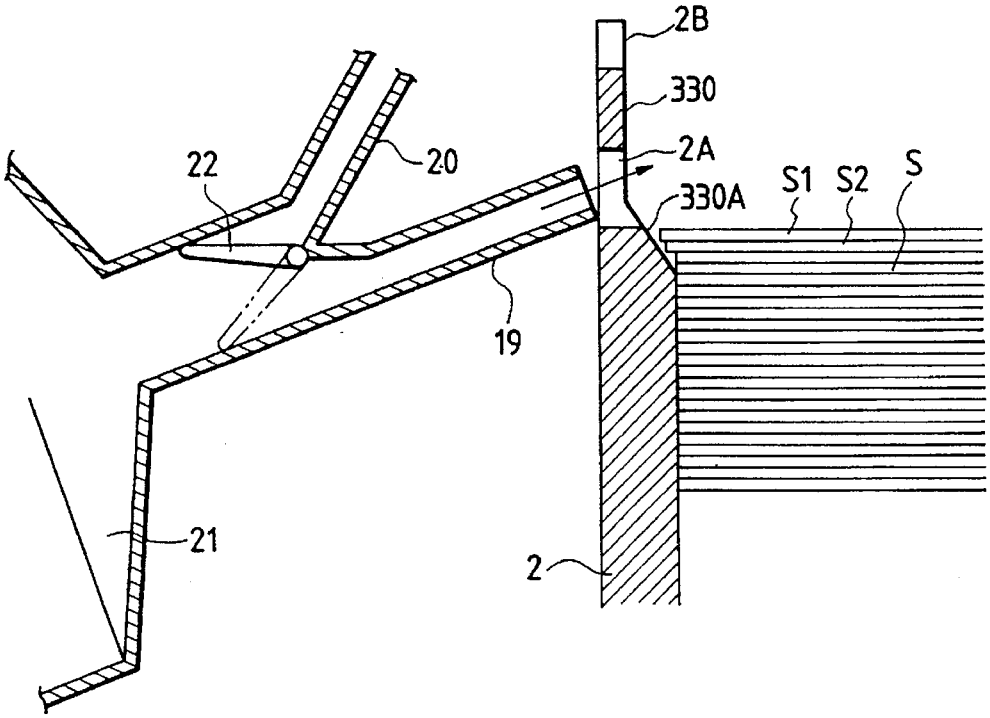
FIG. 40 is an enlarged view of a portion of the sheet supply apparatus of FIG. 38 in a sheet lifting condition.

FIG. 38 shows a condition that the sheet tray 1 has been shifted upwardly to the predetermined position. In this condition, an upper portion of the sheet stack rested on the sheet tray 1 enters into the area of the auxiliary regulating surface 330. Accordingly, before the sheet tray 1 is shifted upwardly, as shown in FIG. 39, even if tip ends of upper sheets S1, S2 are abutted against the tip end regulating plate 2 while being bent, when the sheet tray 1 is shifted upwardly, as shown in FIG. 40, since the upper sheets S1, S2 enter into the area of the auxiliary regulating surface 330, the tip ends of the sheets S1, S2 which were regulated by the tip end regulating plate 2 while being bent are released by the auxiliary regulating surface 330, with the result that the sheets are returned to their flat conditions due to the resiliency.

Figure 41:
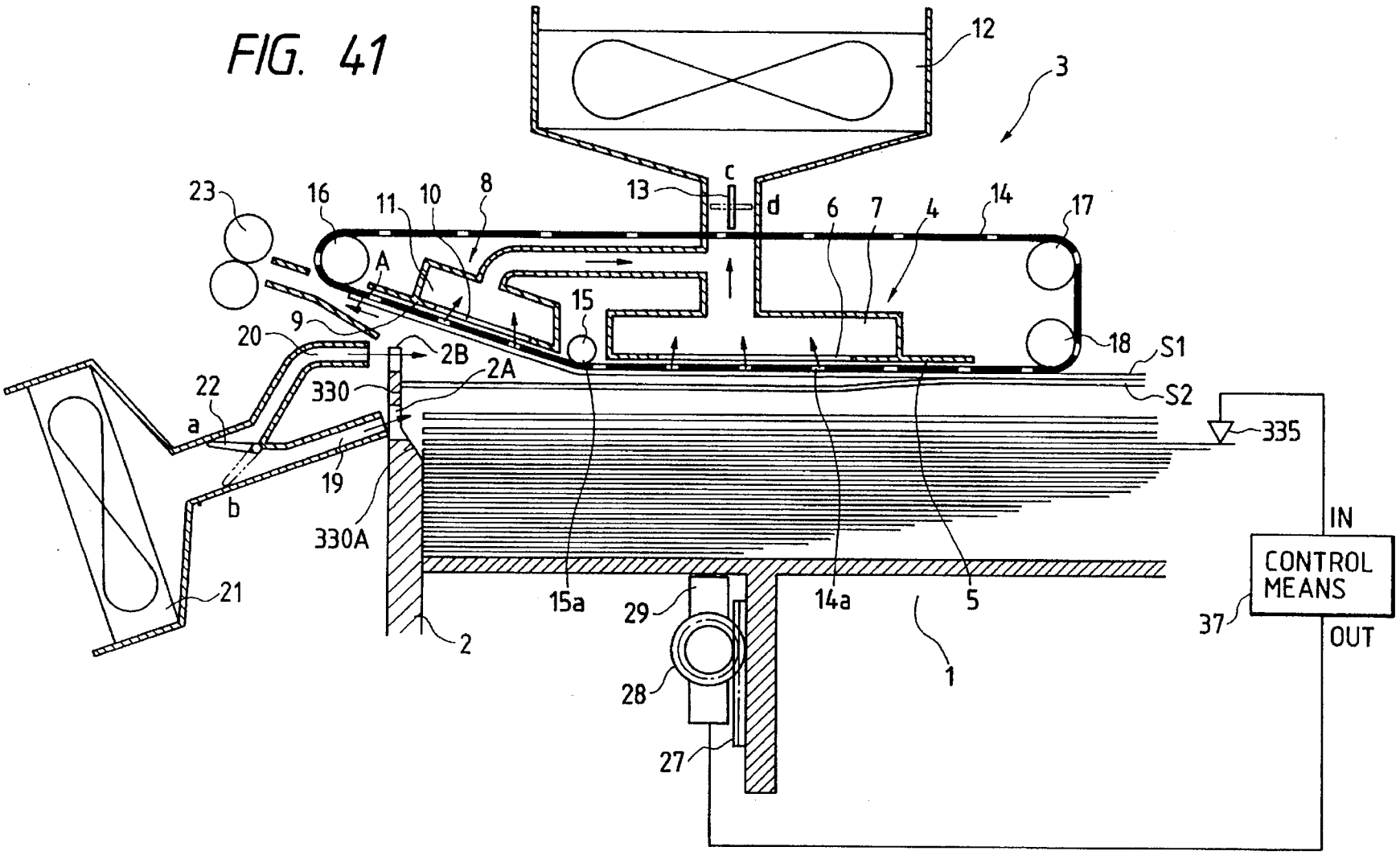
FIG. 41 is a view similar to FIG. 38, showing a sheet supplying condition.
Figure 42:
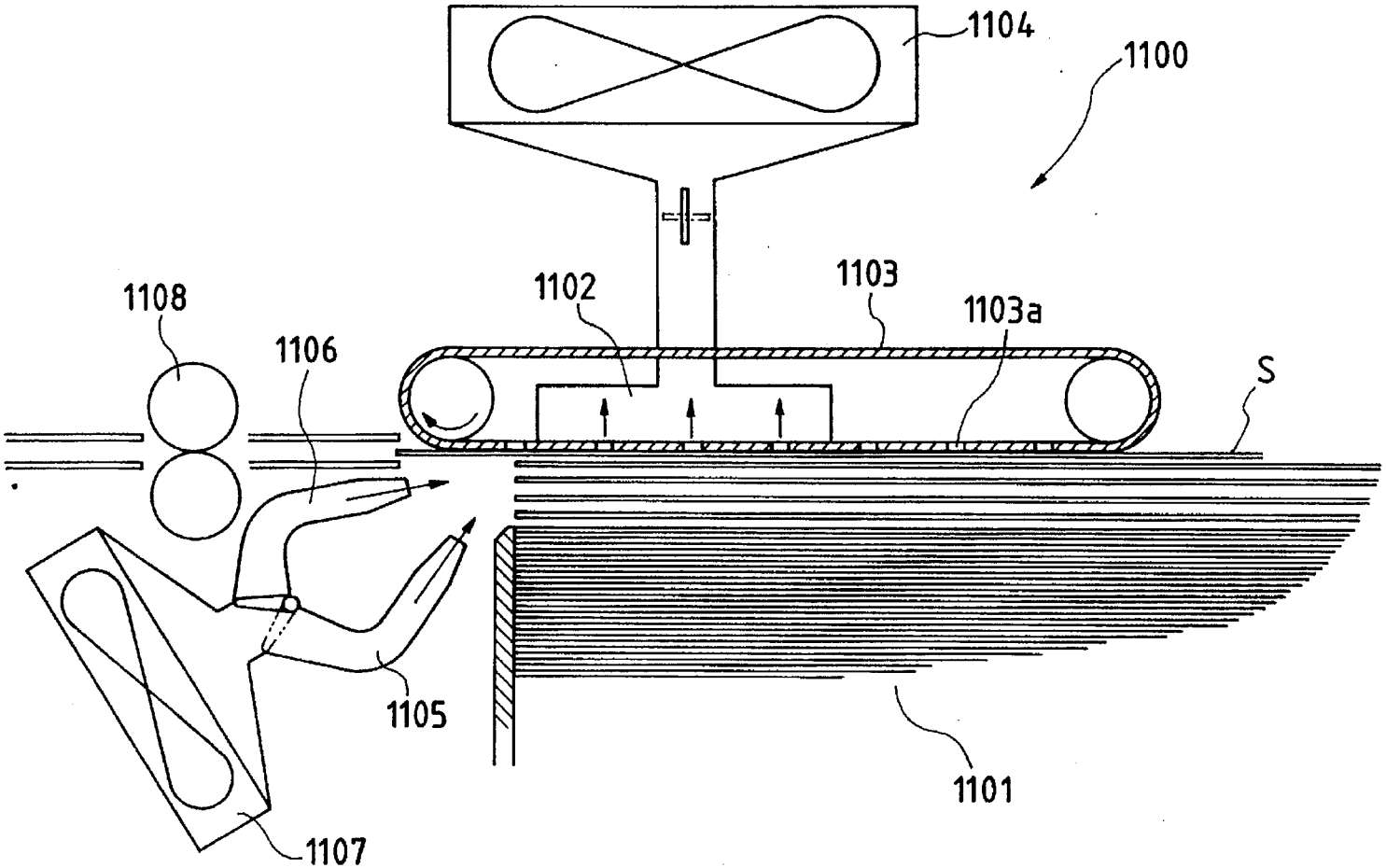
FIG. 42 PRIOR ART
FIG. 42 is a sectional view of a conventional sheet supply apparatus of air absorb type.

Thus, the upper sheets S1, S2 are wholly floated positively by the air injected from the air blowing nozzle 19 and are positively absorbed to the surface of the convey belt 14 by negative pressure generated in the suction chambers 7, 11 of the sheet absorb portions 4, 8. When the convey belt 14 is rotated, the second sheet S2 overlapped with the uppermost sheet S1 is separated from the uppermost sheet by the air injected from the air blowing nozzle 20. If the sheet S2 is hard to be separated from the sheet S1, as shown in FIG. 41, since the sheet S2 is regulated by the auxiliary regulating surface 330, the double-feed of sheets can be prevented.

What is claimed is:

1. A sheet supply apparatus comprising:

sheet supporting means for supporting sheets;

sheet absorb means for absorbing a sheet supported by said sheet supporting means to thereby separate the sheet from the other sheets;

convey means for conveying the sheet absorbed by said sheet absorb means; and sheet feature detecting means for detecting a rigidity of the sheet absorbed by said sheet absorb means.

2. A sheet supply apparatus according to claim 1, wherein said sheet feature detecting means has a displacement member protrudable from an absorb surface of said sheet absorb means and adapted to be displaced in accordance with the detected rigidity of the sheet when abutted against the sheet, and a position detecting member for detecting a position of the displaced displacement member.

3. A sheet supply apparatus according to claim 1 or 2, wherein said sheet absorb means includes a suction chamber having an opening opposed to the sheet supported by said sheet supporting means; and said convey means comprises a rotatable convey belt mounted to cover the opening of said suction chamber and having suction holes therein.

4. A sheet supply apparatus according to claim 1 or 2, wherein said sheet absorb means includes a first suction chamber having an opening opposed to the sheet supported by said sheet supporting means, and a second suction chamber arranged at a downstream side of said first suction chamber and having an opening inclined with respect to said opening of said first suction chamber by a predetermined angle; and said convey means has a rotatable convey belt mounted to cover said opening of said first suction chamber and the opening of said second suction chamber, and having suction holes therein.

5. A sheet supply apparatus according to claim 4, wherein said sheet feature detecting means has a first sheet presence/absence detection means for detecting the sheet absorbed by said first suction chamber, a second sheet presence/absence detection means for detecting the sheet absorbed by said second suction chamber, and judge means for detecting a time difference between a start of detection of said first sheet presence/absence detection means after absorbing operations of said first and second suction chambers are simultaneously started and a start of detection of said second sheet presence/absence detection means after the absorbing operations of said first and second suction chambers are simultaneously started and for judging rigidity of the sheet on the basis of a detected result.

6. A sheet supply apparatus according to claim 4, wherein a suction force of said second suction chamber is greater than a suction force of said first suction chamber.

7. An image forming apparatus comprising:

a sheet supply apparatus according to claim 1; and an image forming means for forming an image on the sheet supplied from said sheet supply apparatus.

8. A sheet supply apparatus comprising:

sheet supporting means for supporting sheets, said sheet supporting means mounted for lifting and lowering movements;

sheet absorb means arranged above said sheet supporting means for absorbing a sheet supported by said sheet supporting means to separate the sheet from other sheets;

convey means for conveying the sheet absorbed by said sheet absorb means;

sheet feature detecting means for detecting rigidity of the sheet absorbed by said sheet absorb means; and control means for controlling the lifting and lowering movements of said sheet supporting means to change a distance between said sheet absorb means and an uppermost sheet in accordance with the rigidity of the sheet detected by said sheet feature detecting means.

9. A sheet supply apparatus according to claim 8, wherein said control means controls the lifting and lowering movements of said sheet supporting means in such a manner that the smaller the rigidity of the sheet detected by said sheet feature detecting means the greater a distance between said sheet absorb means and an uppermost sheet.

10. A sheet supply apparatus according to claim 8 or 9, wherein said sheet feature detecting means has a displacement member protrudable from an absorb surface of said sheet absorb means and adapted to be displaced in accordance with the detected rigidity of the sheet when abutted against the sheet, and a position detecting member for detecting a position of the displaced displacement member.

11. A sheet supply apparatus according to claim 10, wherein said sheet absorb means includes a suction chamber having an opening opposed to the sheet supported by said sheet supporting means; and said convey means comprises a rotatable convey belt mounted to cover the of said suction chamber and having suction holes therein.

12. An image forming apparatus comprising:

a sheet supply apparatus according to claim 8; and an image forming means for forming an image on the sheet supplied from said sheet supply apparatus.

13. A sheet supply apparatus comprising:

sheet supporting means to thereby separate the sheet from the other sheets for supporting sheets;

first sheet absorb means for absorbing a sheet from the sheets supported by said sheet supporting means;

second sheet absorb means arranged at a downstream side of said first sheet absorb means and having an absorb surface inclined with respect to an absorb surface of said first sheet absorb means for absorbing a tip end portion of the sheet absorbed by said first sheet absorb means while deforming the sheet;

angle changing means for changing angles of said absorb surfaces of said first and second sheet absorb means;

convey means for conveying the sheet absorbed by said first and second sheet absorb means;

sheet feature detecting means for detecting a rigidity of the sheet absorbed by said sheet absorb means; and control means for controlling said angle changing means to change the angles of said absorb surfaces of said first and second sheet absorb means in accordance with the rigidity of the sheet detected by said sheet feature detecting means.

14. A sheet supply apparatus according to claim 13, wherein said control means controls said angle changing means in such a manner that the smaller the rigidity of the sheet detected by said sheet feature detecting means, the greater an angle around which the sheet is bent.

15. A sheet supply apparatus according to claim 13 or 14, wherein said sheet feature detecting means comprises a displacement member protrudable from an absorb surface of said first sheet absorb means and adapted to be displaced in accordance with the detected rigidity of the sheet when abutted against the sheet, and a position detecting member for detecting a position of the displaced displacement member.

16. A sheet supply apparatus according to claim 13 or 14, wherein said sheet feature detecting means has a first sheet presence/absence detection means for detecting the sheet absorbed by said first absorb means, a second sheet presence/absence detection means for detecting the sheet absorbed by said second absorb means, and a judge means for detecting a time difference between a start of detection of said first sheet presence/absence detection means after absorbing operations of said first and second absorb means are simultaneously started and a start of detection of said second sheet presence/absence detection means after the absorbing operations of said first and second absorb means are simultaneously started and for judging rigidity of the sheet on the basis of a detected result.

17. A sheet supply apparatus according to claim 13, wherein said first sheet absorb means has a first suction chamber having an opening opposed to and substantially in parallel with the sheet supported by said sheet supporting means; said second absorb means has a second suction chamber having an opening inclined with respect to said opening of said first suction chamber by a predetermined angle; and said convey means has a rotatable convey belt mounted to cover said opening of said first suction chambers and said opening of said second suction member, and having suction holes therein.

18. A sheet supply apparatus according to claim 17, wherein said angle changing means has a support shaft for pivotally supporting said second suction chamber, and a drive mechanism for rocking said second suction chamber around said support shaft.

19. A sheet supply apparatus according to claim 17, wherein a suction force of said second suction chamber is greater than a suction force of said first suction chamber.

20. An image forming apparatus comprising:

a sheet supply apparatus according to claim 13; and an image forming means for forming an image on the sheet supplied from said sheet supply apparatus.

* * * * *

UNITED STATES PATENT AND TRADEMARK OFFICE

CERTIFICATE OF CORRECTION

PATENT NO. : 5,645,274

DATED : July 8, 1997

INVENTOR(S) : Shinsuke UBAYASHI, et al.

It is certified that error appears in the above-identified patent and that said Letters Patent is hereby corrected as shown below:

Column 1, line 51, delete "downstreamly" and insert therefor --downstream--.

Column 5, line 18, delete "downstreamly" and insert therefor --downstream--.

Column 7, line 40, delete "devices" and insert therefor --device--;
Line 49, delete "206" and insert therefor --207--.

Column 8, line 34, delete "if".

Column 11, line 23 delete "black" and insert therefor --block--.

Column 12, line 17, delete "t";
Line 21, delete "black" and insert therefor --block--.

Column 13, line 2, delete "75" and insert therefor --175--.

UNITED STATES PATENT AND TRADEMARK OFFICE

CERTIFICATE OF CORRECTION

PATENT NO. : 5,645,274

DATED : July 8, 1997

INVENTOR(S) : Shinsuke UBAYASHI, et al.

It is certified that error appears in the above-identified patent and that said Letters Patent is hereby corrected as shown below:

Column 17, line 20, delete "P4" and insert therefor --F4--.

Column 18, line 15, delete "downstreamly" and insert therefor --downstream--.

Column 20, line 44 delete "sheet" and insert therefor --sheets--.

Column 22, line 35, delete "of said".

Signed and Sealed this

Seventeenth Day of February, 1998

Bruce Lehman

*Attest:*

BRUCE LEHMAN

*Attesting Officer*

*Commissioner of Patents and Trademarks*